US006637492B2

(12) United States Patent
Welfonder

(10) Patent No.: US 6,637,492 B2
(45) **Date of Patent: *Oct. 28, 2003**

(54) DRIVE MECHANISM AND HEAD RAIL FOR A BLIND

(75) Inventor: Konrad Welfonder, Bremerhaven (DE)

(73) Assignee: Hunter Douglas Industries B.v., Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/223,935

(22) Filed: Aug. 19, 2002

(65) Prior Publication Data

US 2003/0000654 A1 Jan. 2, 2003

Related U.S. Application Data

(63) Continuation of application No. 09/615,681, filed on Jul. 14, 2000, now Pat. No. 6,474,393.

(30) Foreign Application Priority Data

Jul. 14, 1999 (EP) ..... 99305593

(51) Int. Cl.[7] ..... E06B 9/30

(52) U.S. Cl. ..... 160/168.1; 160/177.1 V; 160/178.1 V

(58) Field of Search ..... 160/168.1, 173 V, 160/174 V, 177.1 V, 178.1 V, 900; 318/280, 480; 475/301, 320

(56) References Cited

U.S. PATENT DOCUMENTS

| | | | | | |
|---|---|---|---|---|---|
| 4,137,788 | A | | 2/1979 | Fischer | 74/242.9 |
| 4,406,436 | A | | 9/1983 | Benthin | 248/262 |
| 4,836,345 | A | * | 6/1989 | Anderson | 192/20 |
| 4,936,369 | A | * | 6/1990 | Darner | 160/168.1 |
| 5,179,989 | A | * | 1/1993 | Schon | 160/84.1 |
| 5,266,068 | A | * | 11/1993 | Benthin | 475/301 |
| 5,291,946 | A | * | 3/1994 | Ciraci | 160/177 |
| 5,304,071 | A | | 4/1994 | Bannai et al. | 439/164 |
| 5,444,339 | A | * | 8/1995 | Domel et al. | 318/17 |
| 5,611,386 | A | * | 3/1997 | Wang | 160/344 |
| 5,714,855 | A | * | 2/1998 | Domel et al. | 318/280 |
| 5,760,558 | A | * | 6/1998 | Popat | 318/480 |
| 5,845,695 | A | | 12/1998 | Cadorette et al. | 160/173 V |
| 5,909,093 | A | * | 6/1999 | van Dinteren et al. | 318/16 |
| 5,950,701 | A | * | 9/1999 | Rogers | 160/177 V |
| 6,060,852 | A | * | 5/2000 | Domel et al. | 318/480 |
| 6,112,798 | A | * | 9/2000 | Cheng | 160/176.1 |
| 6,149,094 | A | * | 11/2000 | Martin et al. | 242/373 |
| 6,474,393 | B1 | * | 11/2002 | Welfonder | 160/168.1 V |

FOREIGN PATENT DOCUMENTS

| | | | |
|---|---|---|---|
| DE | 2161117 | 6/1973 | 9/36 |
| EP | 0 012 263 | 11/1979 | 9/36 |
| EP | 0536537 | 6/1994 | |
| EP | 0467627 | 4/1995 | |
| EP | 0672816 | 9/1995 | |
| EP | 0810347 | 12/1997 | |
| EP | 0889193 | 1/1999 | |

* cited by examiner

*Primary Examiner*—Bruce A. Lev
(74) *Attorney, Agent, or Firm*—Dorsey & Whitney LLP

(57) ABSTRACT

A head rail for a vertical blind, the head rail being elongate and having a drive mechanism at one end for selectively tilting and retracting slats of the vertical blind along the length of the head rail, the drive mechanism including a rotatable tilt drive for tilting slats, a rotatable retract drive for retracting and deploying slats, and a transmission for rotating the tilt drive and the retract drive by means of a single rotatable source, wherein the transmission includes a clutch for rotating the tilt drive, the clutch incorporating a lost motion mechanism whereby, after a predetermined number of rotations in the same direction, transmission by the clutch to the tilt drive is disengaged and wherein the transmission includes a control gear which is located at a position along the length of the head rail so that it can be meshed with teeth of an external drive source.

19 Claims, 17 Drawing Sheets

2
4
6
8
10
12
14
16
22
28
30
32
34
36
38
40
42
44
58
II
II

DRIVE MECHANISM AND HEAD RAIL FOR A BLIND

CROSS-REFERENCE TO RELATED APPLICATIONS

This application is a continuation of U.S. application Ser. No. 09/615,681, filed Jul. 14, 2000 now U.S. Pat. No. 6,474,893, which application corresponds to and claims priority to European Application No. 99305593.8, filed Jul. 14, 1999. The above-identified applications are hereby incorporated by reference as though fully set forth herein.

BACKGROUND OF THE INVENTION a. Field of the Invention

The present invention relates to a drive mechanism and a head rail for a blind, in particular to a drive mechanism and head rail allowing tilting and retraction of the blind slats.

b. Background Art

Previously, it was known to provide a vertical blind suspended from a head rail for covering an architectural opening. Each vertical slat is suspended from a carriage which is movable towards and away from one end of the head rail. Traditionally, some form of chain or cord extends in a loop along the length of the head rail so as to retract and deploy the carriages. Furthermore, a rotatable rod also extends the length of the head rail and rotation of the rod is transferred by the carriages so as to rotate the vertical slats.

Traditionally, the two operations of tilting and retraction are controlled by separate cords or chains hanging down from the head rail. However, EP-A-0467627 discloses a system by which both operations may be controlled by means of a single cord. In particular, a lost motion mechanism is provided between an input wheel driven by the control cord and drive to the retraction mechanism. Furthermore, slip is allowed to occur between the input control wheel and the tilt mechanism once the slats have reached their full tilt in either direction. In this way, movement of the control cord will first operate the tilt mechanism and then, once the slats have been fully tilted and the lost motion mechanism has come to the end of its travel, the slats are either retracted or deployed.

It has also been proposed to control blind movement by means of a motor, for instance in DE-U-9406083. However, this creates additional problems. The provision of two motors and associated control for the two slat operations is unduly bulky, heavy and expensive. Furthermore, the provision of a single motor with appropriate servo operation to direct power selectively to the two slat operations is also unduly complicated and expensive. With respect to the system of EP-A-0467627, it is undesirable to use a motor in conjunction with the slip mechanism provided for the tilt of slats, since the force required for slip needs to be carefully matched to the torque available from the motor. Indeed, even for manual cord operation, the slip mechanism is undesirable, because of the associated wear of its components.

BRIEF SUMMARY OF THE INVENTION

According to the present invention, there is provided a head rail for a vertical blind, the head rail being elongate and having a mechanism at one end for selectively tilting and retracting slats of the vertical blind along the length of the head rail, the mechanism having a control gear, the rotation of which affects the selective tilting and retracting, wherein the control gear is located at a position along the length of the head rail so that it can be meshed with teeth of an external drive source.

In this way, the head rail may be constructed independently of any power source. A single head rail may be fitted with different power sources according to requirements. For instance, motor units may be provided which are operated remotely or by means of cords. Alternatively, a manually operated mechanism, for instance with cords, may be provided as the drive source.

Similarly, different types and lengths of head rail may be provided and all be useable with the same drive source.

Preferably, the head rail includes a housing forming a generally enclosed structure, the housing including an aperture by which the control gear may mesh with the teeth of an external drive source. In this respect, the control gear can be rotatable about an axis parallel to the extent of the head rail.

In this way, an aesthetically pleasing head rail may be provided. In particular, the head rail can include a housing to conceal all of the various operating parts of the head rail. However, by providing an aperture for the control gear, the head rail can still be operated by an external drive source.

Preferably, the aperture is located in the housing such that it is generally not visible in use. In this respect, the housing can have an elongate surface from which the slats may extend, for instance a lower surface, and at least one other parallel elongate surface, for instance a back surface, in which the aperture is formed.

Preferably the mechanism has another control gear, the rotation of which affects the selective tilting and retracting, the housing has another parallel elongate surface in which another aperture is formed by which the control gear may be operated by the teeth of an external drive source.

The same control gear may be meshed with the teeth of the external drive source, or the mechanism may have another control gear as part of a gear train which affects the selective tilting and retracting. In this case, the another control gear may mesh with the teeth of the external drive source.

In this way, flexibility is provided in the way in which the external drive source may be mounted to the head rail. In particular, the second aperture and control gear may be provided towards the upper surface of the head rail.

According to the present invention, there is also provided a head rail as described above in combination with a motor unit for attachment to the at least one other parallel elongate surface of the head rail, the motor unit having a toothed drive gear for meshing with the control gear.

Preferably, the motor unit is a generally elongate structure having an elongate attachment surface for mounting alongside the at least one other parallel elongate surface.

A latch and clip arrangement may be provided as defined in the appended claims for attaching the motor unit to the head rail.

According to the present invention, there is also provided a drive mechanism for a blind having an array of retractable and tiltable slats, the mechanism including:

- a rotatable tilt drive for tilting slats;
- a rotatable retract drive for retracting and deploying slats; and
- a transmission for rotating the tilt drive and the retract drive by means of a single rotatable source; wherein the transmission includes a clutch for rotating the tilt drive, the clutch incorporating a first lost motion mechanism whereby, after a predetermined number of rotations in the same direction, transmission by the clutch to the tilt drive is disengaged.

In this way, both the tilt and retract operations of a blind may be controlled from a single rotatable source. Furthermore, by means of the lost motion mechanism and clutch, drive to the tilt mechanism is completely disengaged during drive of the retract mechanism. Hence, undue load on the drive source is avoided, together with wear of any components which were required to slip according to previous arrangements.

The drive mechanism is particularly advantageous in conjunction with the head rail defined above, since it provides the single control gear for operation by a drive source.

Preferably, the clutch comprises a cylindrical drive surface to be driven by the single rotatable source and a wrap spring such as a coil spring arranged to grip the drive surface, the wrap spring having radially extending ends for rotating the tilt drive.

The lost motion mechanism can include respective wrap spring release surfaces adjacent the ends of the wrap spring such that, when the wrap spring release surfaces are prevented from rotating and an end of the wrap spring rotates into abutment with a respective one of the wrap spring release surfaces, the wrap spring is resiliently deformed so as to release the grip on the drive surface.

In this way, transmission from the rotatable source to the tilt drive passes through the wrap spring and by using the wrap spring release surfaces to deform the wrap spring, drive to the wrap spring from the drive surface is disengaged.

In contrast, the tilt drive includes respective tilt surfaces adjacent the ends of the wrap spring such that, when an end of the wrap spring is rotated into abutment with a respective tilt surface, the grip of the wrap spring on the drive surface is tightened and the tilt drive is rotated.

In this way, the wrap spring passes drive from the drive surface to the tilt surfaces so as to rotate the tilt drive.

Preferably, the wrap spring surrounds the drive surface and the ends of the wrap spring extend radially outwardly. The wrap spring release surfaces and tilt surfaces are then formed on the edges of components extending axially around the outer periphery of the wrap spring and adjacent its ends.

The lost motion mechanism may include a series of co-axial wheels each constrained to be rotatable relative to an adjacent wheel through only a limited extent.

Alternative lost motion mechanisms may also be provided so as to allow only a limited amount of rotation of the wrap spring release surfaces. Indeed, according to the present invention, there may be provided a lost motion mechanism comprising first and second components relatively rotatable about a common axis;

a spacer disposed between the first and second components; and a flexible elongate member having ends attached respectively to the first and second components wherein relative rotation of the first and second components causes the flexible elongate member to wrap around the spacer such that the first and second components can rotate relative to one another by an amount determined by the length of the flexible elongate member.

The first lost motion mechanism may be such a lost motion mechanism.

Preferably, the retract drive is rotated by the transmission by means of a second or retract lost motion mechanism such that the retract drive is only rotated after a predetermined number of rotations of the transmission in the same direction.

In this way, the retract drive is not operated during initial operation of the tilt drive.

Preferably, the retract lost motion mechanism has a greater extent of lost motion than the tilt lost motion mechanism such that transmission to the tilt drive is disengaged before transmission is provided to the retract drive.

In this way, slats of the blind may be fully tilted and their drive disengaged before any retraction or deployment starts.

The second lost motion mechanism may comprise first and second components relatively rotatable about a common axis;

a spacer disposed between the first and second components; and a flexible elongate member having ends attached respectively to the first and second components wherein relative rotation of the first and second components causes the flexible elongate member to wrap around the spacer such that the first and second components can rotate relative to one another by an amount determined by the length of the flexible elongate member.

According to the present invention, there is provided a drive mechanism for a blind comprising:

an output gear rotatable relative to a housing for at least one of moving and tilting blind slats;

a planet gear mating with the output gear;

an input drive rotatable by a user for moving the planet gear in a circular path around the output gear; wherein the planet gear is restrained to limited rotation relative to the housing such that rotation of the input drive causes rotation of the output gear, but the output gear is unable to transmit drive back through to the input drive.

In this way, a user may provide drive to move or tilt the blind slats such that the blind slats will remain securely in the position in which they are left. In particular, the weight of the blind slats or any attempt to move them will cause the drive mechanism to lock up, thereby preventing any motion.

Preferably, this drive mechanism may be used in conjunction with the mechanisms described above in respect of one or both of the tilt and retract operations.

The present invention will be more clearly understood from the following description, given by way of example only, with reference to the accompanying drawings.

BRIEF DESCRIPTION OF THE DRAWINGS

FIG. 2(*b*) illustrates the cross-section of FIG. 2(*a*) with the handle in the locked position;

FIG. 5(*b*) illustrates the cross-section of FIG. 5(*a*) with the handle in the locked position;

DESCRIPTION OF THE PREFERRED EMBODIMENTS

Figures 1A, 1B:
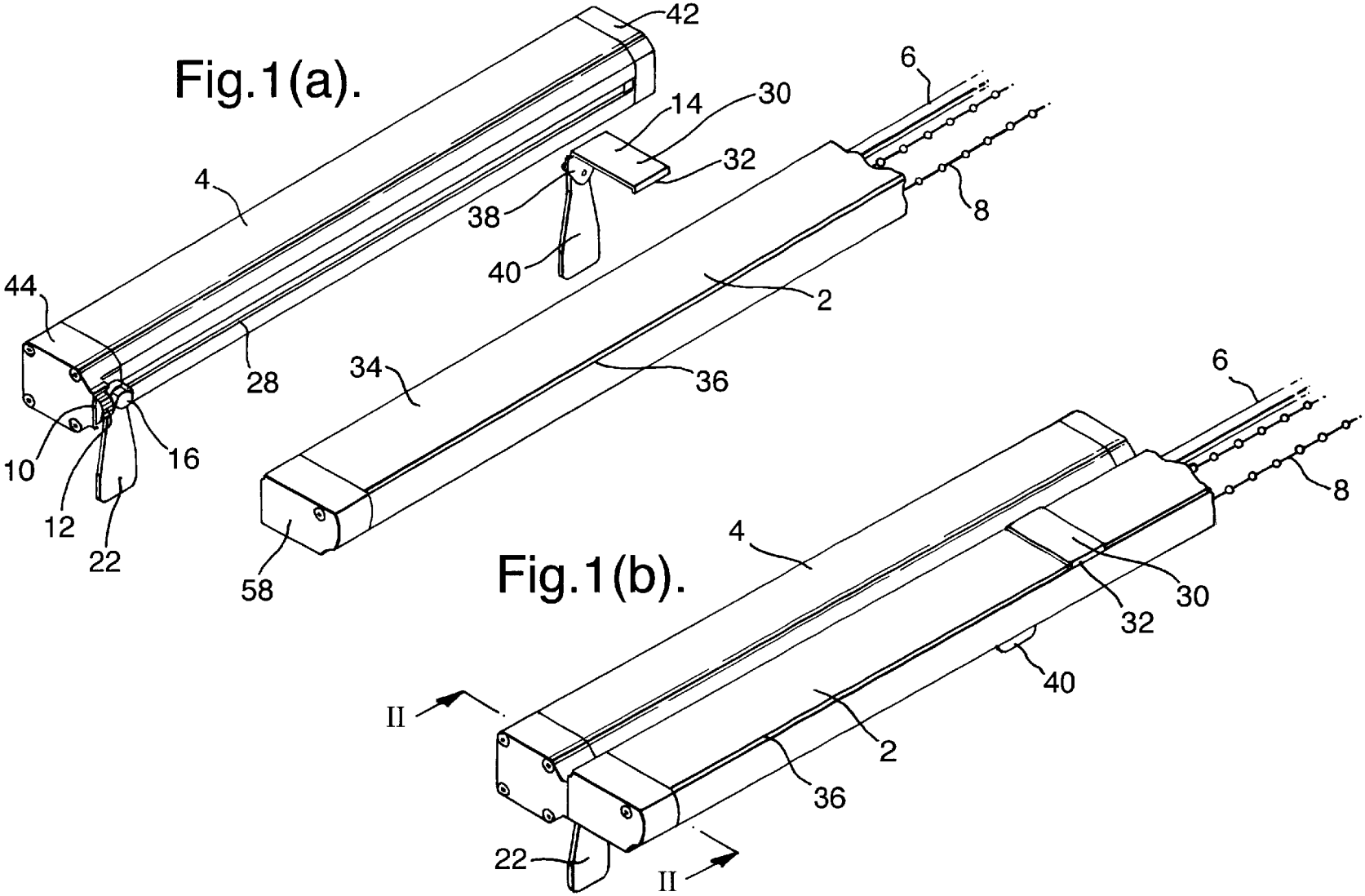
FIGS. 1(*a*) and (*b*) illustrate a vertical blind head rail in conjunction with an associated motor unit.

Referring to FIGS. 1(*a*) and (*b*) there is illustrated an end section of a head rail 2 and an associated motor unit 4, together forming a head rail assembly.

Within the head rail 2 are preferably housed a number of carriages (not illustrated) each for suspending a vertical blind (also not illustrated). A tilt rod 6 extends along the length of the head rail 2 and passes through each of the carriages. By rotating the tilt rod 6, the suspended vertical blinds may be tilted. A retraction chain 8 also extends up and down the length of the head rail 2. By moving the chain 8, the carriages may be deployed along or retracted from the length of the head rail 2.

As illustrated, the motor unit 4 is provided as a separate integral unit. The motor unit is provided with an aperture 10 through which a toothed drive gear 12 extends. As will be described below, the end of the head rail 2 is provided with a corresponding aperture allowing the toothed drive gear 12 to mesh with a control gear in the head rail 2.

In order to attach the motor unit 4 to the head rail 2, there is provided a clip 14 and a latch 16.

The latch 16 comprises a non-circular head 18 which may be inserted through a corresponding non-circular opening 20 in the head rail 2. This is illustrated in FIGS. 2(*a*), where FIG. 2(*a*) is the cross-section II—II of FIG. 1(*b*).

Figure 2A:
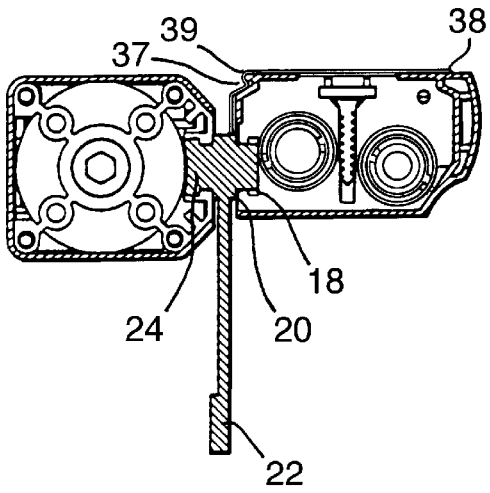
FIG. 2(*a*) illustrates the cross-section II—II through the arrangement of FIG. 1(*b*)
Figure 2B:
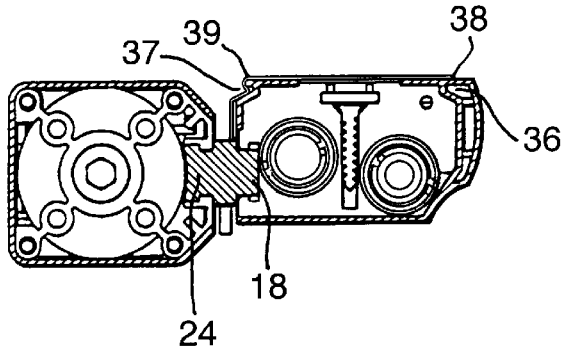

By rotating the latch 16 and the non-circular head 18 to the position illustrated in FIG. 2(*b*), where FIG. 2(*b*) is a cross-section corresponding to that of FIG. 2(*a*), the latch 16 holds the motor unit 4 in place alongside the head rail 2. Preferably, although not illustrated, the head 18 also extends rearwardly towards the motor unit 4 such that, as it is rotated to the position of FIG. 2(*b*), it provides pressure on the inside of the head rail 2, thereby gripping the head rail 2 closely to the motor unit 4.

Preferably, as illustrated, the latch 16 is also provided with a handle 22 which takes a concealed position between the motor unit 4 and head rail 2 when the latch 16 is in the position holding the motor unit 4 to the head rail 2.

The latch 16 may be mounted to the motor unit 4 in any suitable manner allowing rotation. However, as illustrated in the figures, the latch 16 has a generally circular head 24 which is rotationally mounted in the housing 26 of the motor unit 4.

Figure 3:
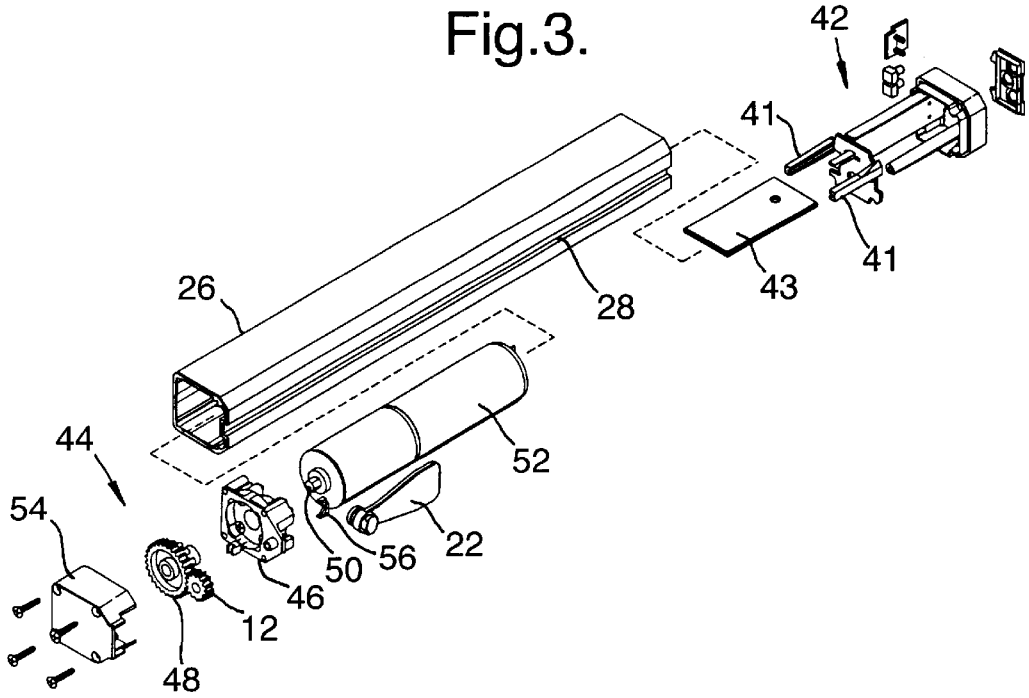
FIG. 3 illustrates component parts of a motor unit.

Referring to FIG. 3, it will be seen that the housing 26 of the motor unit 4 is constructed having a lipped channel section 28 along one side. Hence, preferably, the head 24 of the latch 16 is fitted into the channel section 28. In this way, the latch 16 is attached to the housing 26 of the motor unit 4 but is allowed freely to rotate.

The handle 22 may be provided with a detent protrusion 23 which fits into the channel section 28 of the motor unit 4. In particular, when the latch 16 and handle 22 are rotated to the locked position, the detent protrusion 23 moves into the channel section 28 to hold the handle 22 in place.

As illustrated, the clip 14 includes a plate section 30 with a tongue 32. The housing 34 of the head rail 2 is provided with an elongate groove 36 into which the tongue 32 may be fitted. The clip 14 then has a latch (not illustrated) similar to latch 16. In particular, on a down turned section 38 of the plate section 30, a rotatable shaft is provided with a non-circular head. The non-circular head may be inserted into the lipped channel 28 of the motor unit 4 and then rotated so as to lie behind the lips of the channel and secure the clip 14 in place. As with the latch 16, the clip latch is preferably provided with a head which tightens on to the lips as it is rotated. As illustrated, a handle 40 is provided for rotating the clip latch and, as with the handle 22, is concealed between the head rail 2 and motor unit 4 when the clip 14 is secured to the motor unit 4. The handle may also include a detent protrusion.

The housing 34 illustrated in FIGS. 2(*a*) and (*b*) also includes an elongate groove 37 opposite the elongate groove 36. In this way, the plate section 30 may have an in-turned section 39 to resiliently fit into the elongate groove 37 and hence, together with the down turned section 38 and elongate groove 36, more securely grip the housing 34 of the head rail 2.

Starting from the arrangement of FIG. 1(*a*), the clip 14 is positioned over the head rail 2 such that its tongue 32 grips the groove 36. The motor unit 4 is then brought along side the head rail 2 and the head 18 of the latch 16 is inserted through the aperture 20 of the head rail 2 and the head of the clip latch is inserted into the lipped channel 28. This is illustrated in FIG. 1(*b*). In this position, the clip 14 may still be moved along the length of the motor unit and head rail 2. Preferably, it is positioned so as best to support the weight of the motor unit 4.

The handles 22 and 40 are then rotated so as to secure the motor unit 4 in place. The latch 16 holds the end of the motor unit 4 adjacent the end of the head rail 2 with the drive gear 12 in engagement. Furthermore, the weight of the motor unit 4 on the clip 14 is supported by the plate section 30 on the top of the head rail 2, the tongue 32 preventing the clip 14 slipping around the head rail 2.

Figure 4A:
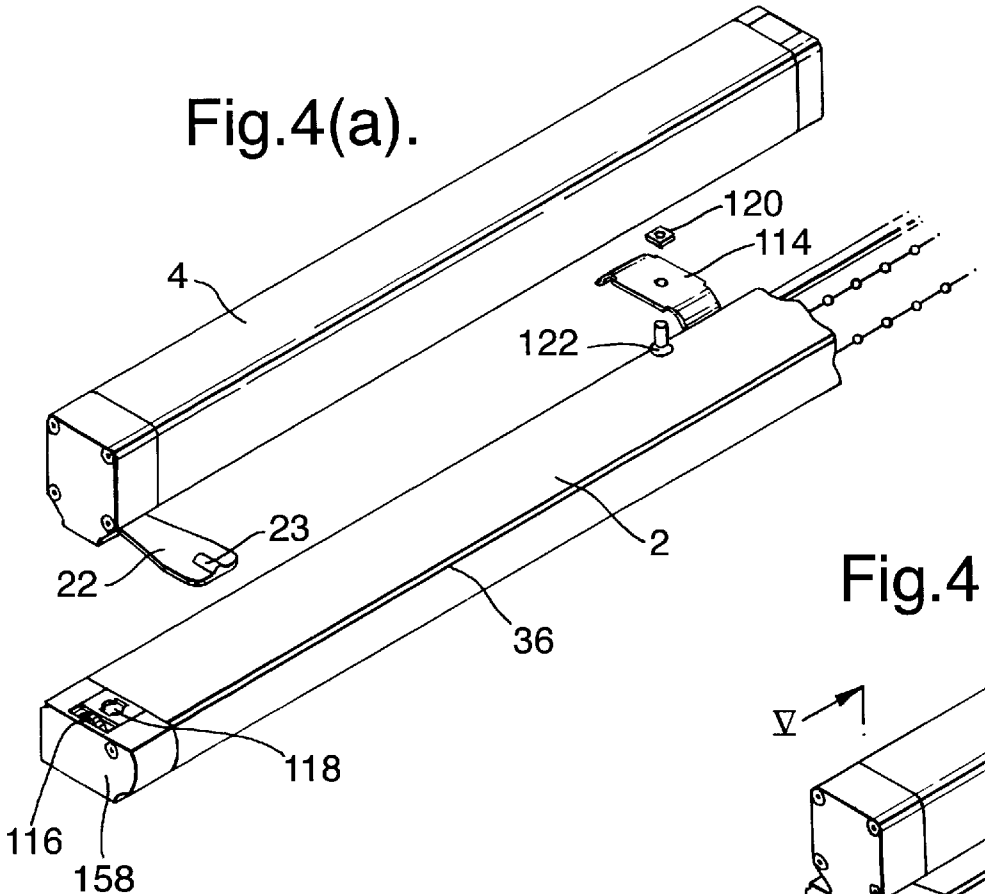
FIGS. 4(*a*) and (*b*) illustrate a vertical blind head rail in conjunction with an associated motor unit.
Figure 4B:
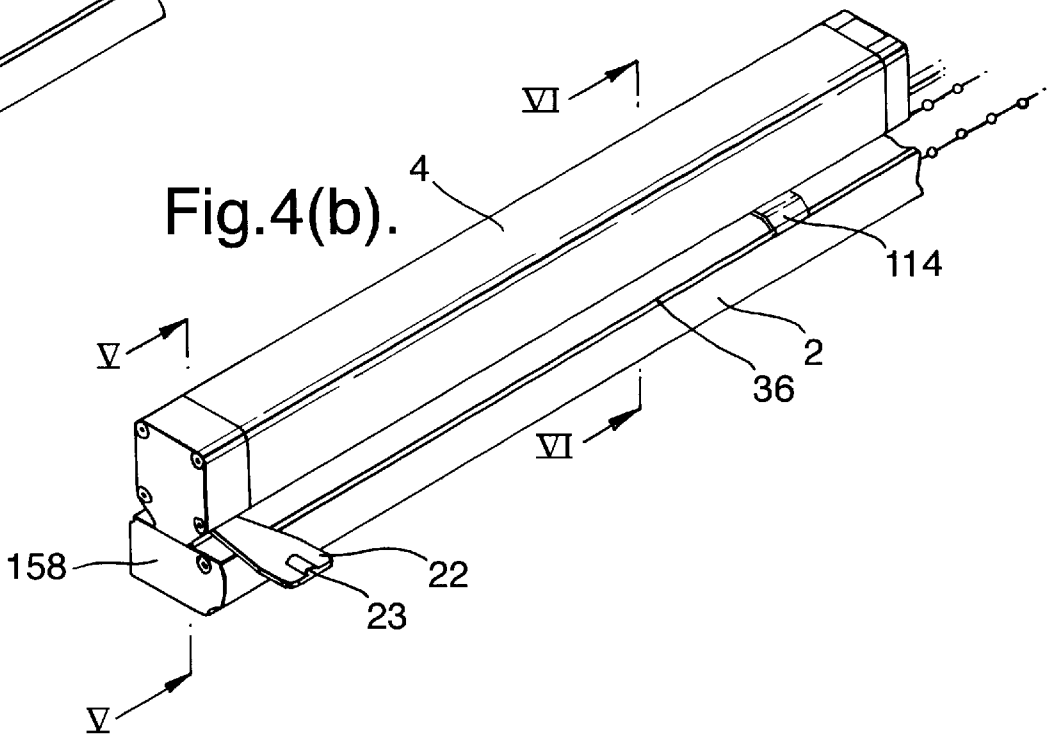

FIGS. 4(*a*) and (*b*) illustrate an alternative arrangement for the motor unit 4 and head rail 2. In particular, in this arrangement, the motor unit 4 is mounted above the head rail 2 along a different side of the head rail 2 to that illustrated in FIGS. 1(*a*) and (*b*).

The motor unit 4 can be identical to that used with the arrangement of FIGS. 1(*a*) and (*b*) and illustrated in FIG. 3. In particular, it also includes the rotatable latch 16 with the handle 22.

Figure 5A:
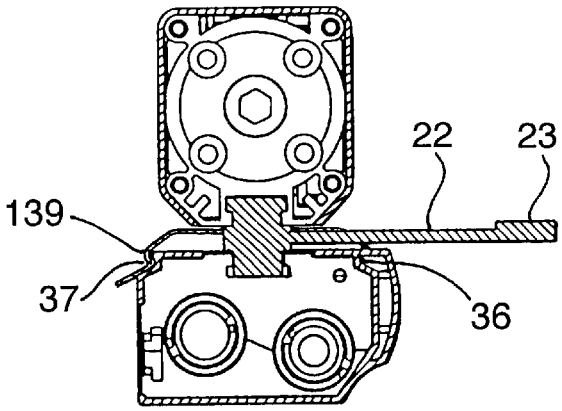
FIG. 5(*a*) illustrates the cross-section V—V through the arrangement of FIG. 4(*b*)
Figure 5B:
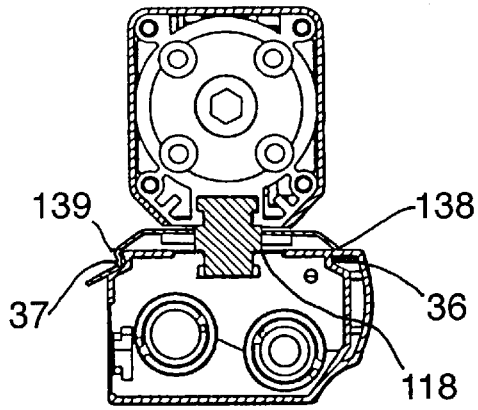

The head rail 2 differs from that of FIGS. 1(*a*) and (*b*) only by the end cap 158. In particular, the end cap 158 illustrated in FIGS. 4(*a*) and (*b*) includes a non-circular opening 118 through which the non-circular head 18 of the latch 16 may be inserted. This is illustrated in more detail in FIG. 5(*a*) which shows the cross-section V—V of FIG. 4(*b*). As with the previous arrangement, by rotating the handle 22, the motor unit 4 may be locked in place against the head rail 2. This is illustrated in FIG. 5(*b*) which is a cross-section corresponding to that of FIG. 5(*a*).

The end cap 158 also includes an aperture 116 through which the toothed drive gear 12 of the motor unit 4 may mesh with a control gear of the head rail.

Figure 6:
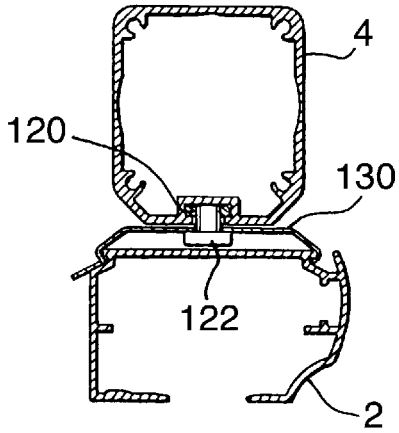
FIG. 6 illustrates the cross-section VI—VI through the arrangement of FIG. 4(*b*)

As with the previous arrangement, a clip is also provided to attach the motor unit 4 to the head rail 2. In this case, the clip 114 has down turned sections 138 and 139 either side of the plate section 130. The down turned sections 138 and 139 fit into the elongate grooves 36 and 37 so as to secure the clip to the head rail 2. On the other hand, an insert 120 is provided to fit into the channel 28 of the motor unit 4 and a screw 122 provided to attach the plate section 130 to the insert 120. This is illustrated in FIG. 6 which is the cross-section VI—VI of FIG. 4(*b*).

Considering FIG. 3, it will be seen that the motor unit includes a first end assembly 42 and a second end assembly 44. The first end assembly in the illustrated embodiment includes a connector for receiving power and control signals if appropriate for remote control. The illustrated embodiment also includes two tongues 41 for receiving a printed circuit board 43. The second end assembly 44 includes a gearing support structure 46 in which a main motor gear 48 and the drive gear 12 are housed. The motor gear 48 is provided on the drive shaft 50 of the motor 52 and meshes with the drive gear 12. A cap 54 may be screwed to the support structure 46 to enclose the gears 48 and 12 and provide and end surface to the motor unit 4.

FIG. 3 also illustrates the provision of an insert 56 which may be fixed in the lipped channel 28 so as to prevent the head 24 of the latch 16 moving longitudinally along the lip channel 28. The support structure 46 may be provided with means to prevent the latch 16 moving in the opposite direction.

Figure 7:
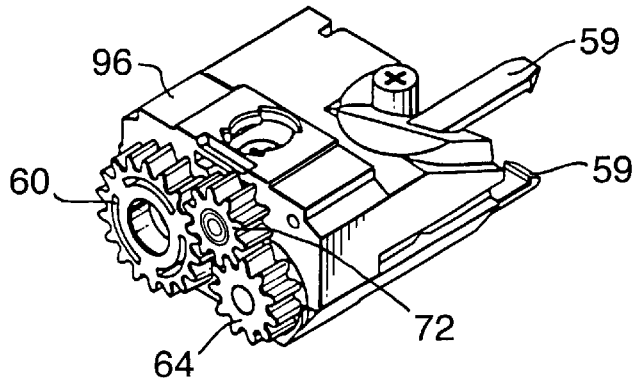
FIG. 7 illustrates a drive mechanism for a blind.
Figure 8:
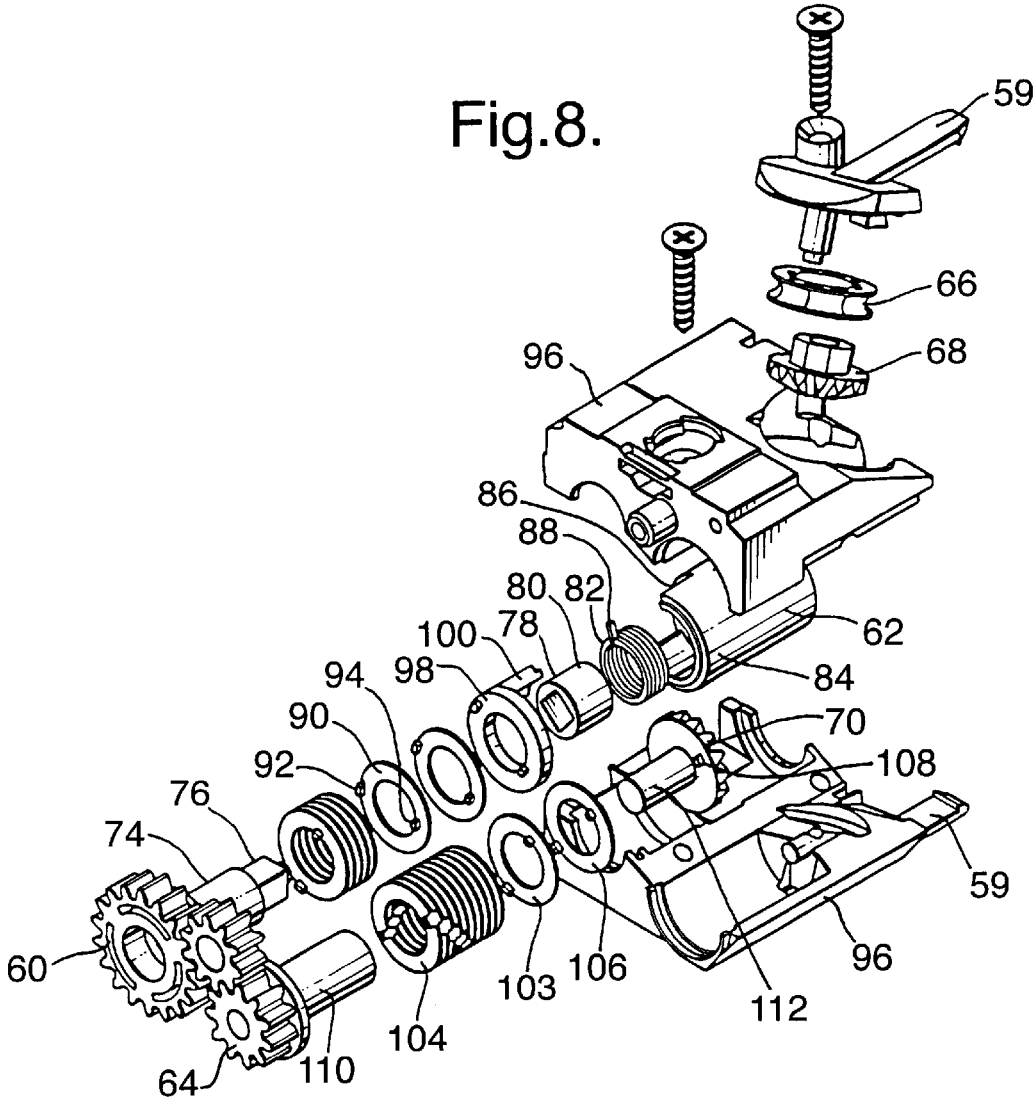
FIG. 8 illustrates an exploded view of the blind mechanism of FIG. 7.

Behind the end cap 58 of the head rail 2, there may be provided a drive mechanism as illustrated in FIGS. 7 and 8.

The drive mechanism incorporates a tilt drive for rotating the rod 6 and a retract drive for rotating the chain 8. In particular, a tilt drive gear 60 rotates a tilt drive 62 connected to the rod 6 and a retract gear 64 rotates a retract drive including a chain wheel 66 and crown gear 68 meshing with gear 70.

The tilt gear 60 and retract gear 64 are provided in a single gear train by both meshing with an intermediate gear 72. In this way, any of the tilt gear, retract gear and intermediate gear may be driven by some drive source, for instance the drive gear 12 described above, in order to operate both the tilt mechanism and the retract mechanism.

Tongues 59 can be provided to hold the last carriage, in other words the last vane carrier/traveller.

Considering first the tilt mechanism, drive from the tilt gear 60 is provided to the tilt drive 62 by means of a transmission comprising a lost motion mechanism and a clutch mechanism.

As is illustrated in FIG. 8, the tilt gear 60 is provided with a shaft 74 having, at its end, a non-circular cross-section end 76, in this case square. A clutch drive component 78 having an outer cylindrical drive surface 80 is fitted onto the non-circular cross-section end 76 of the shaft 74. The drive surface 80 may be provided as an integral part of the shaft 74. However, by providing it as a separate component, the material properties of the drive surface 80 may be chosen independently of those required for the shaft 74 and tilt gear 60.

A wrap spring 82 is fitted around the drive surface 80 such that it lightly grips the drive surface 80. The drive component 78 and wrap spring 82 are then inserted within the tilt drive 62.

Figure 9:
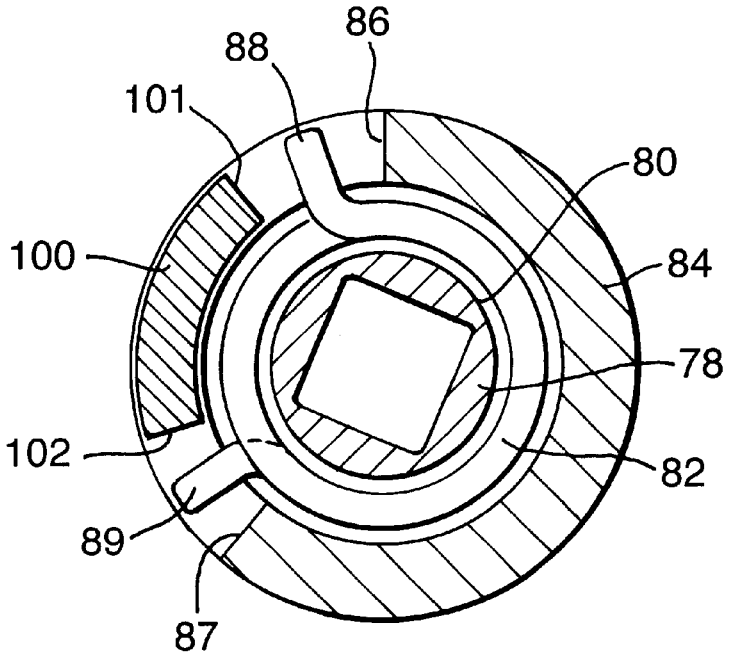
FIG. 9 illustrates a cross-section through the clutch mechanism of the drive mechanism of FIGS. 7 and 8.

As illustrated, particularly with reference to FIG. 9, the tilt drive 62 includes an end section 84 which is of a part cylindrical shape. In particular, the part cylindrical end section 84 surrounds the wrap spring 82 and has tilt surfaces 86, 87 adjacent the ends 88, 89 of the wrap spring 82.

As will be apparent, when the tilt gear 60 and, hence, the drive surface 80 are rotated, the wrap spring 82 will also be rotated due to its frictional engagement with the drive surface 80. In either direction of rotation, an end 88, 89 of the wrap spring 82 will abut a tilt surface 86, 87 of the tilt drive 62. The wrap spring is wound and positioned within the part cylindrical end section 84 such that rotation of an end 88, 89 of the wrap spring 82 against a tilt surface 86, 87 will tend to tighten the wrap spring 82 onto the drive surface 80, thereby increasing the frictional grip between the wrap spring 82 and the drive surface 80. In this way, the end 88, 89 of the wrap spring 82 will rotate the tilt drive 62.

The lost motion mechanism comprises a series of wheels 90 arranged around the shaft 74. Each wheel 90 has some form of protuberance or indent which allows it only to rotate to a limited extent with regard to an adjacent wheel. To reduce the number of wheels required, it is preferred that the available rotation should be as close to 360° as possible.

Figure 10A:
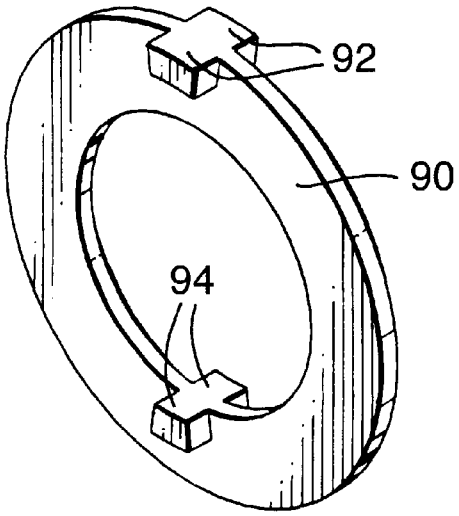
FIGS. 10(*a*) and (*b*) illustrate a lost motion wheel.
Figure 10B:
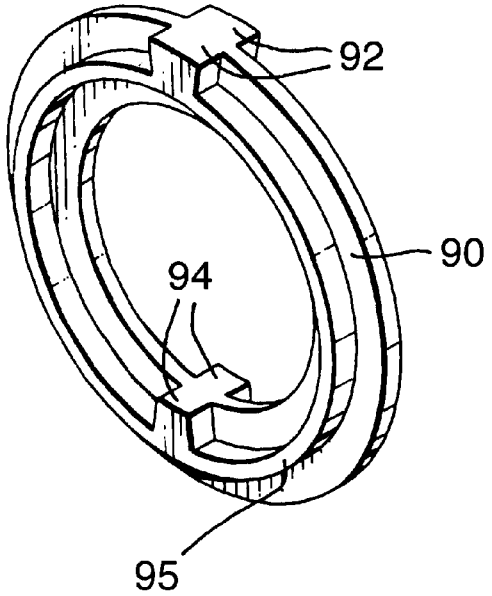

FIGS. 10(*a*) and (*b*) illustrate respectively the front and rear sides of a wheel 90. As illustrated, each wheel includes a pair of protuberances 92, 94 on each side. In particular, at the outer periphery protuberances 92 are provided in each axial direction and, at the inner periphery, protuberances 94 are provided in each axial direction. Furthermore, on the rear side of each lost motion wheel 90, an annular supporting ridge 95 is provided between the protuberances 92 and 94. As will be appreciated, the annular supporting ridge 95 acts as a guide for the protuberances 92, 94 of an adjacent lost motion wheel 90 and assists in maintaining the lost motion wheels 90 in axial alignment.

It will be noted that, in order to provide the lost motion mechanism, it is not necessary to provide two protuberances on each side of a wheel 90. However, the provision of two protuberances spreads the load between adjacent wheels, allows the transmitted torque to be shared between pairs of protuberances and prevents the wheels from becoming skew relative to the axis of the shaft 74. In other words, they increase the abutment surface and thereby reduce/distribute the force on/over each protrusion.

Although not illustrated, the first of the series of wheels 90 is either fixed to the housing 96 of the mechanism or provided with a limited rotation relative to the housing 96 in the same way as to its adjacent wheel 90. As a result, the last wheel 98 of the series of wheels can only rotate relative to the housing 96 through a number of turns determined by the number and nature of the series of wheels 90.

The last wheel 98 is provided with or attached to an extension member 100. As illustrated in FIG. 9, the extension member 100 extends alongside the wrap spring 82 between its two ends 88, 89. In particular, it extends into the gap left by the part cylindrical end section 84 of the tilt drive 62 so as generally to complete the cylinder.

It will be appreciated that when the tilt gear 60, drive surface 80, wrap spring 82 and tilt drive 62 are rotated, then the extension member 100 and last wheel 98 will also be rotated. However, as mentioned above, due to the lost motion mechanism, the extension member 100 and last wheel 98 can only rotate through a limited number of turns relative to the housing 96. Thus, once the extension member 100 has been rotated by its maximum number of turns, it will stop and an end 88, 89 of the wrap spring 82 (the trailing end 88, 89 which in the respective direction of rotation is not rotating the tilt drive 62) will abut a wrap spring release surface 101, 102 of the extension member 100. Further rotation of the wrap spring 82 will cause the end 88, 89 in contact with the wrap spring release surface 101, 102 to be deflected. As will be appreciated, this deflection will open out the wrap spring 82 and, hence, release the grip of the wrap spring 82 on the drive surface 80. Thus, further rotation of the tilt gear 60 and drive surface 80 will result merely in the drive surface 80 slipping with respect to the wrap spring 82. Hence, no further drive will be provided to the tilt drive 62.

Considering clockwise rotation of the drive surface 80 and wrap spring 82 illustrated in FIG. 9, the end 88 of the wrap spring 82 will first abut the tilt surface 86 so as to rotate the part cylindrical end section 84. At the same time the end 89 will abut the wrap spring release surface 102 of the extension member 100 and rotate the extension member 100. However, when the lost motion mechanism reaches the end of its available motion, the extension member 100 will not rotate any further. Hence, when the wrap spring 82 rotates, it will cause the end 89 to be deflected against the wrap spring release surface 102. As a result, grip between the wrap spring 82 and drive surface 80 will be lost and no further rotation will be transmitted from the end 88 to the tilt surface 86 and part cylindrical end section 84.

Thus, continuous drive to the tilt gear 60 will only result in the tilt drive 62 being rotated through a predetermined number of turns. Once those predetermined number of turns have been made, the lost motion mechanism causes the clutch to release further drive. Hence, the tilt gear 60, even when continuously rotated, will only provide sufficient drive to tilt slats between their maximum tilt positions.

Similarly, modifications may be made to the clutch mechanism. For instance, by altering where the ends 88, 89 of the wrap spring 82 are positioned, it is possible that the extension member 100 will make up the greater extent of the cylinder formed by the extension member 100 and the part cylindrical end section 84 of the tilt drive 62. Also, the drive surface 80 may be an internal cylindrical surface with the ends 88, 89 of the wrap spring 82 extending inwardly to drive the tilt drive and be released by the lost motion mechanism.

Considering now the retract mechanism, a lost motion mechanism is provided between the retract gear 64 and the retract drive 66, 68, 70.

As illustrated, this retract lost motion mechanism comprises a series of wheels 103 similar to the wheels 90 described above. Of course, as for the lost motion mechanism of the tilt drive, this retract lost motion mechanism can be constructed in other ways.

The first wheel 104 of the series of wheels is either attached to the retract gear 64 or is restrained to rotate only to a limited extent relative to the retract gear 64. Similarly, the last wheel 106 is attached to the gear 70 or restrained to rotate only to a limited extent relative to the gear 70. In this respect, in the illustrated embodiment, the back of gear 70 is provided with protrusions, one of which 108 is illustrated, to interact with the protrusions of the last wheel 106.

In this way, rotation of the retract drive 66, 68, 70 only starts after a predetermined number of turns of the retract gear 64.

As illustrated, the retract gear 64 is provided with a shaft 110 about which the lost motion wheels 103 may rotate. Furthermore, the shaft 110 is further provided with an internal cylindrical opening for receiving and supporting for rotation a shaft 112 of the gear 70.

With regard to the connection between the chain wheel 66 and crown gear 68, it is proposed to provide an overload clutch. In particular, the crown gear 68 engages with the chain wheel 66 in such a way that it will slip given sufficient force. As a result, any forcible movement of the blind or chain will cause the chain wheel 66 to slip relative to the crown gear 68 rather than cause damage to the drive mechanism. This will be described and illustrated further in the following embodiments.

Figure 11:
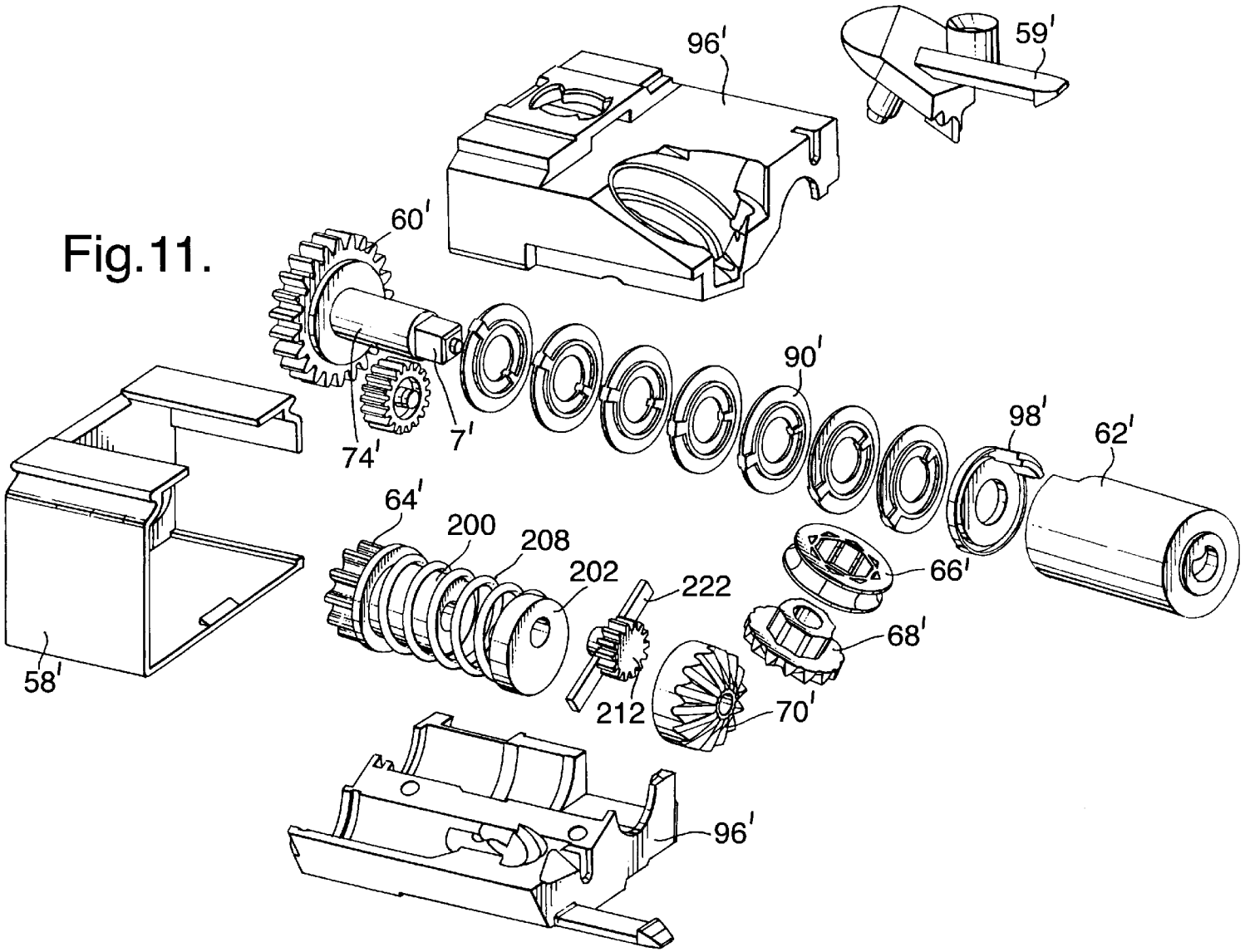
FIG. 11 illustrates an exploded view of an alternative blind mechanism.

FIG. 11 illustrates an alternative lost motion mechanism for the retract mechanism. This is illustrated in more detail in FIGS. 12(*a*) and 12(*b*). Similar reference numerals as used in FIGS. 11 to 13 with the index denote functionally equivalent parts to those explained with reference to FIGS. 1 to 10.

The retract gear 64' has attached to it or integral with it a cylindrical spacer 200. At the distal end of the spacer 200, there is an intermediate drive component 202. As illustrated, the intermediate drive component 202 includes a short pivot shaft 204 which pivots in a bearing aperture 206 in the end of the spacer 200. Thus, the intermediate drive component 202 is spaced from the retract gear 64' and is able to rotate relative to the retract gear 64' about the same axis.

A flexible elongate member 208 such as a thin cord or filament is attached to the intermediate drive component 202 at one end 210. The other end of the elongate member 208 is attached to the back surface of the retract gear 64' or to the spacer 200 proximate the back surface of the retract gear 64'.

Thus, when the retract gear 64' is rotated, it first rotates relative to the intermediate drive component 202 and wraps the elongate member 208 around the spacer 200. When all of the length of the elongate member 208 has been taken up around the periphery of the spacer 200, the end 210 of the elongate member 208 then pulls on the intermediate drive component 202 so as to rotate it. Upon rotation of the retract gear 64' in the opposite direction, the elongate member 208 will rotate relative to the intermediate drive component 202 and unwind the elongate member 208 from around the spacer 200. Upon further rotation, it will then wrap the elongate member 208 around the spacer 200 in the opposite direction such that eventually the end 210 of the elongate member 208 will rotate the intermediate drive component 202 in that opposite direction.

If the elongate member 208 is attached to the back surface of the retract gear 64' or to a component attached to or integral with the retract gear 64', then it is possible for the spacer 200 to be rotatable relative to the retract gear 64'. The spacer 200 is provided merely for a surface about which the flexible elongate member 208 may be wrapped so as to take up its length. Drive between the retract gear 64' and the intermediate drive component 202 is taken through the flexible elongate member 208 and it is only necessary that the ends of the elongate member 208 be attached to the relatively rotatable components. Thus, as another alternative, the spacer 200 can be formed integrally with the intermediate drive component 202 and mounted rotationally with respect to the retract gear 64'.

Figure 12A:
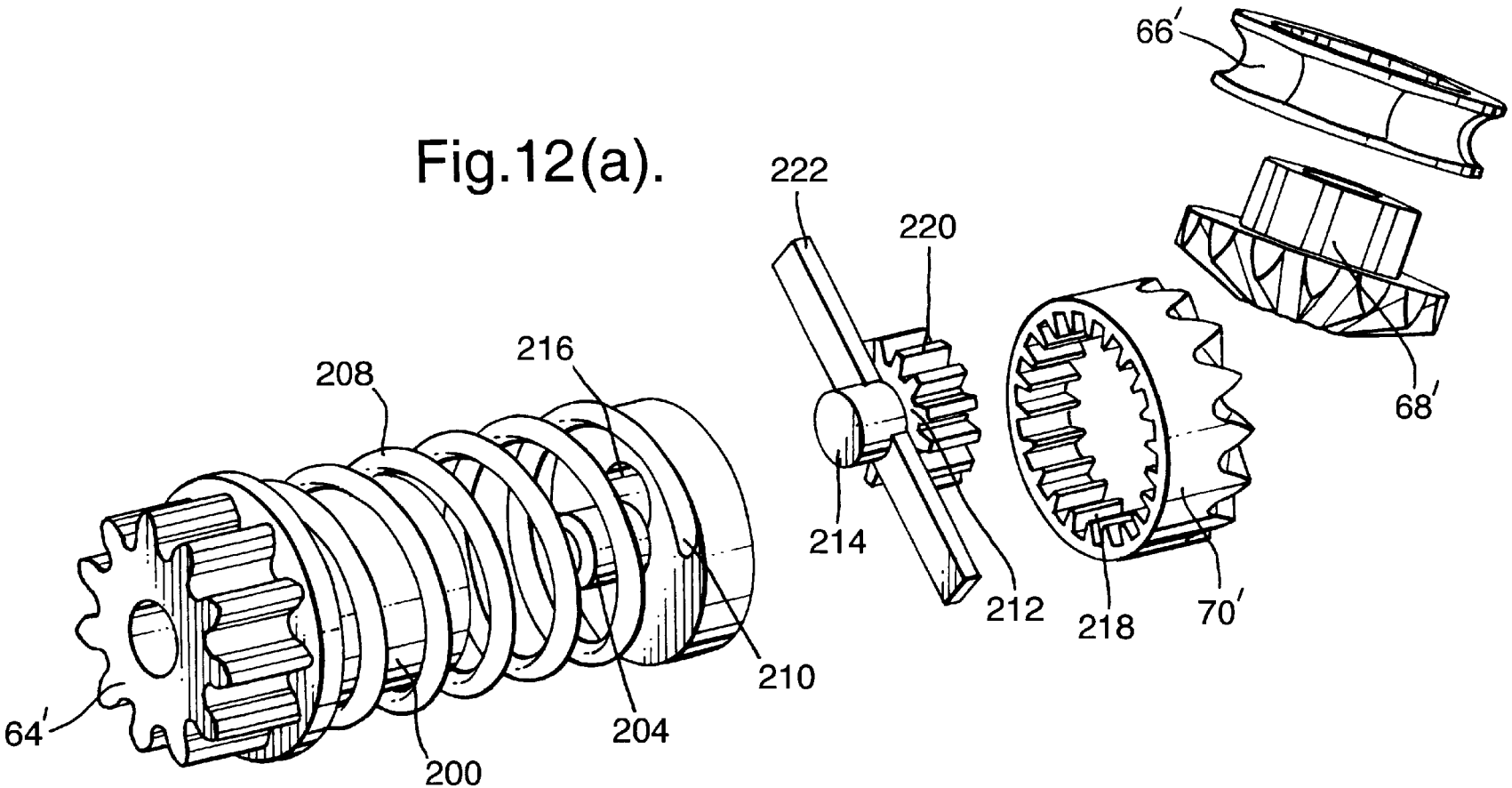
FIGS. 12(*a*) and (*b*) illustrate the retract mechanism of FIG. 11.
Figure 12B:
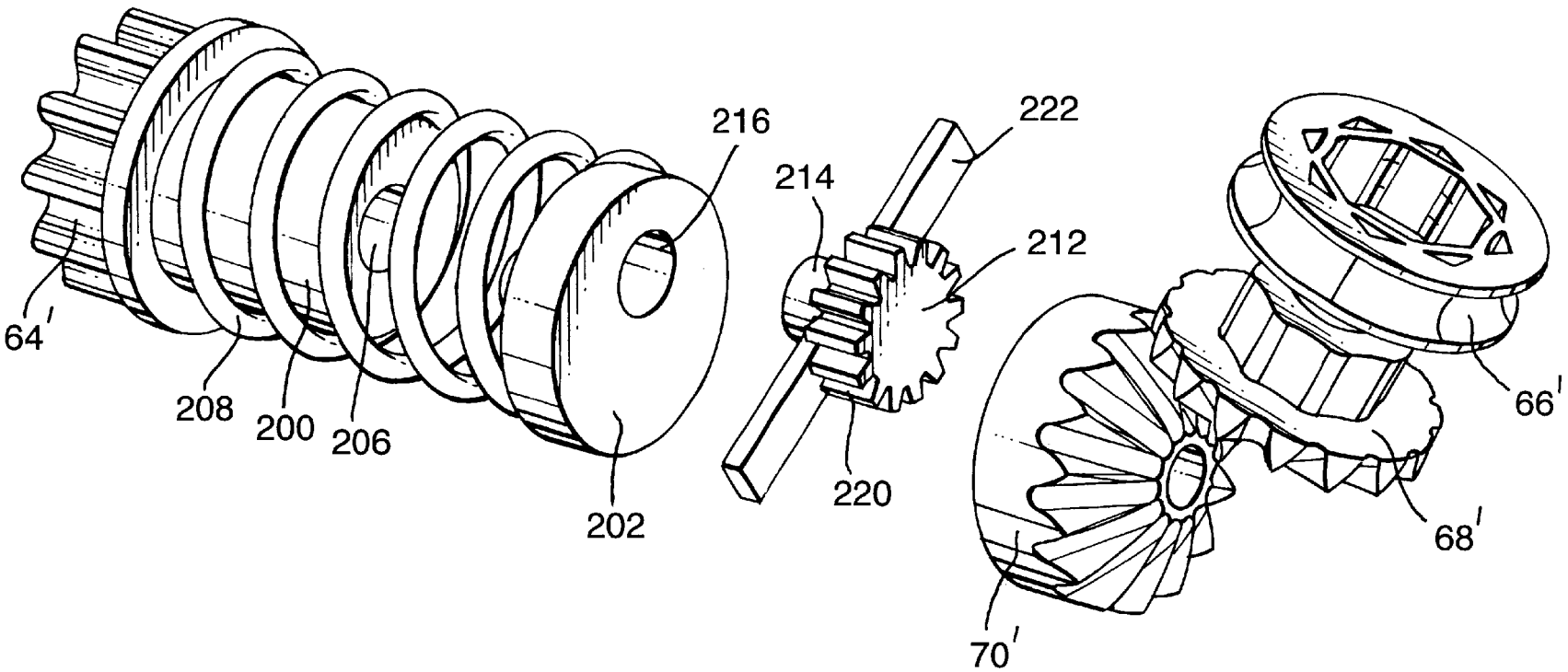

Drive from the intermediate drive component 202 to the retract drive 66', 88' and 70' as illustrated in FIGS. 11, 12(*a*) and 12(*b*) will be described below.

It will be appreciated that other similar lost motion mechanisms can be used in place of that illustrated. For instance, mechanisms employing a ball travelling in a spiral groove are known whereby motion is only allowed while the ball travels between the two ends of the spiral groove.

It should also be appreciated that these various lost motion mechanism can also be used in place of the lost motion mechanism described with reference to FIG. 8 for the tilt gear arrangement.

Considering overall operation, upon rotation of the gear train 60, 64, 72 in one direction, drive will immediately be transmitted via the clutch mechanism of the tilt drive to rotate the slats of the blind in the relevant direction. However, at this time, the lost motion mechanism of the retract drive will not transmit any drive to retracting or deploying the slats. Once the lost motion mechanism of the tilt drive has reached its full extent, the clutch mechanism of the tilt drive will disengage drive to tilting the slats. On the other hand, once the lost motion mechanism of the retract drive has reached its full extent, drive will be provided to retract or deploy the slats.

It will be appreciated that the lost motion mechanism of the retract drive should not reach its full extent until the lost motion mechanism of the tilt drive has reached its full extent and disengaged the clutch. Preferably, the lost motion mechanism of the retract drive has an extent which is at least equal or greater than the extent of the lost motion mechanism of the tilt drive. In particular, so that retraction or deployment of the slats does not occur immediately at the end of tilting the slats, a period of no action should preferably be provided. This is particularly advantageous when the drive mechanism is powered by a motor, since it will be difficult for a user to precisely control the motor to stop its operation at the changeover between tilt drive and retract drive.

Referring again to FIGS. 11, 12(*a*) and 12(*b*), it will be seen that an additional drive mechanism exists between the intermediate drive component 202 and the retract output gear 70'. In particular, a planet gear 212 transmits drive from the intermediate drive component 202 to the output gear 70'. The planet gear 212 includes a pivot shaft 214 which pivots in a bearing aperture 216 in the intermediate drive component 202.

As can be seen from the figures, the aperture 216 is offset from the axis of the intermediate drive 202 such that rotation of the intermediate drive 202 causes the planet gear 212 to move along a circular path.

The retract output gear 70' is of annular form with inwardly facing teeth 218. The outwardly facing teeth 220 of the planet gear 212 mate or mesh with the inwardly facing teeth 218 of the gear 70'.

The planet gear 212 is also provided with two radially extending arms 222*a* and 222*b*. The arms 222*a* and 222*b* fit into corresponding openings 224*a* and 224*b* in the housing 96' such that the planet gear 212 is only able to rotate by a limited amount relative to the housing 96'.

In operation, when the retract mechanism is operated and the intermediate drive 202 is rotated, the planet gear 212 is moved in a circular path around the retract output gear 70'. Since the planet gear 212 is restrained from rotation by the arms 222*a* and 222*b*, the interference between its outwardly facing teeth 220 and the inwardly facing teeth 218 of the output gear 70' causes the output gear 70' to rotate.

Figure 13:
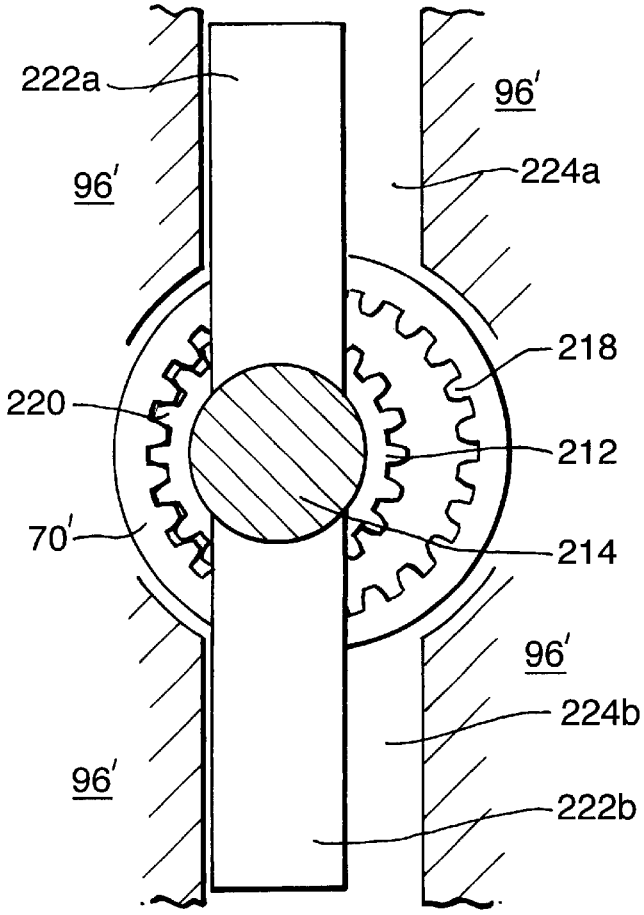
FIG. 13 illustrates a cross-section through a part of the mechanism of FIG. 11 illustrating the planet gear and output gear.

With reference to FIG. 13, when the intermediate drive 202 moves the pivot shaft 214 in a clockwise circular path, the planet gear 212 attempts to rotate anti-clockwise about its own axis. However, upon such rotation, the upper arm 222*a* will abut the left side of the opening 224*a* and the lower arm 222*b* will abut the right hand wall of the opening 224*b*. With the planet gear 212 restrained in this manner, further movement of the planet gear 212 in its circular path will cause the output gear 70' to rotate.

Similarly, anti-clockwise movement of the planet gear 212 about its circular path will cause it to rotate clockwise about its own axis until the arms 222*a* and 222*b* abut the opposite walls of the openings 224*a* and 224*b*.

In contrast, when an attempt is made to rotate the gear 70' to transmit motion back through the mechanism, the mechanism locks up. Thus, the weight of the slats or pulling of the slats in either direction will not operate the mechanism and the slats will be held securely in place.

When an attempt is made to rotate the output gear 70', the mating gears 218 and 220 attempt to rotate the planet gear 212 about its own axis, i.e. rotating shaft 214 in aperture 216. However, in the same way as described above, the arms 222*a* and 222*b* abut walls of the openings 224*a* and 224*b* so as to prevent such rotation. In this way, the planet gear 212 is unable to move any further and, in particular, is not moved around the circular path required to move the intermediate drive 202.

Of course, this mechanism will also have the same effect in various other configurations, for instance with the planet gear on the outside of an output gear having outwardly facing teeth. Similarly, the planet gear 212 will transmit rotation from the intermediate drive 202 to the output gear 70' or lock up whenever it is restrained from rotation relative to the housing. However, it could be allowed to rotate through a limited extent between these two situations. For instance, the planet gear 212 could be limited to rotate by nearly a complete revolution.

It should be appreciated that this mechanism could be used with or without the lost motion and single drive mechanisms described above. Similarly, it could be used in conjunction with the tilt drive.

As illustrated, the output gear 70' meshes with a crown gear 68' which in turn engages a chain wheel 66'. As described above for the previous embodiment, the chain wheel 66' mates with the crown gear 68' to form an overload clutch. In particular, the mating part of the crown gear 68' is provided with a series of radial protrusions which are of generally rounded shape. The corresponding inwardly facing portions of the chain wheel 66' are formed as resilient bridge pieces which extend over recesses and are, therefore, radially outwardly deflectable. Thus, if the chain wheel 66' is forcibly rotated relative to the crown gear 68', the bridge pieces are able to deflect and allow relative rotation between the chain wheel 66' and the crown gear 68'. In this way, forcible movement of the blind or chain will cause relative rotation between the chain wheel 66' and the crown gear 68' rather than damaging the drive mechanism. Of course, the mating surfaces of the chain wheel 66' and crown gear 68' could be reversed with the resilient parts being provided on the crown gear 68'. Indeed, other forms of overload clutch could also be used.

FIGS. 14 to 18 illustrate an alternative embodiment to that of FIGS. 11, 12 and 13. Similar reference numerals as used in FIGS. 14 to 18 with the index "denote functionally equivalent parts to those explained above with reference to FIGS. 11 to 13.

Figure 16:
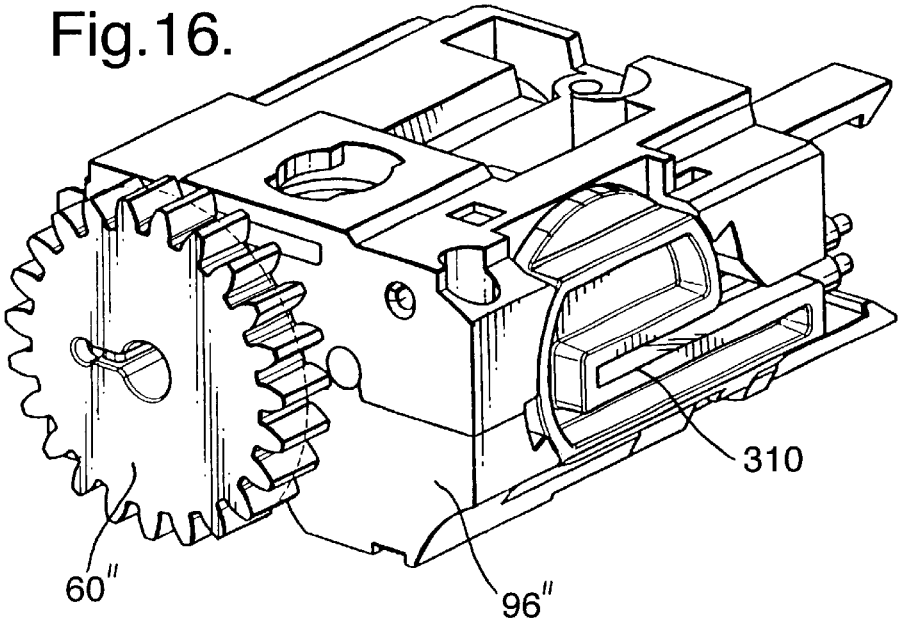
FIG. 16 illustrates the assembled mechanism of FIGS. 14(*a*), 14(*b*) and 15.
Figure 14A:
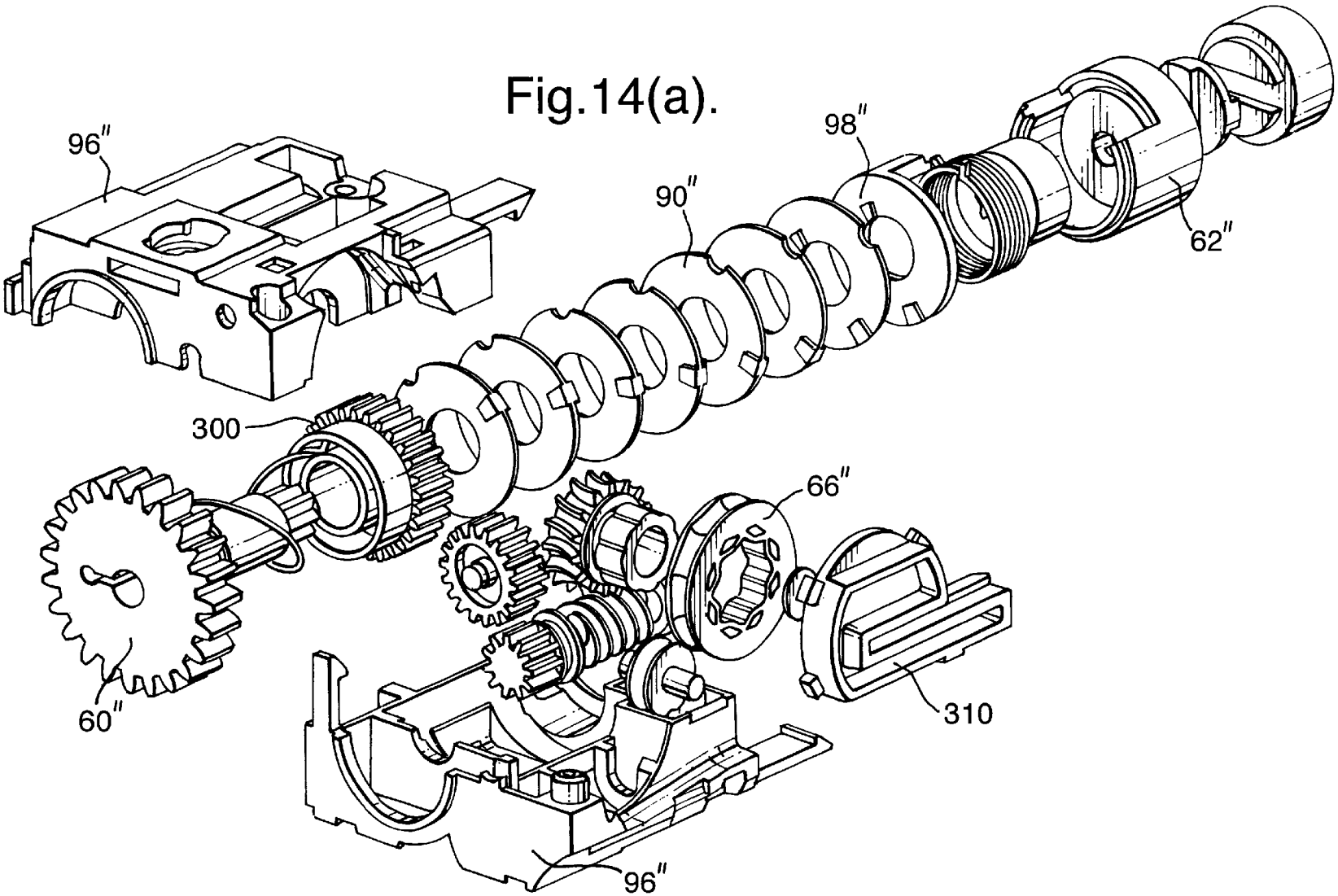
FIGS. 14(*a*), 14(*b*) and 15 illustrate exploded views of an alternative blind mechanism.
Figure 14B:
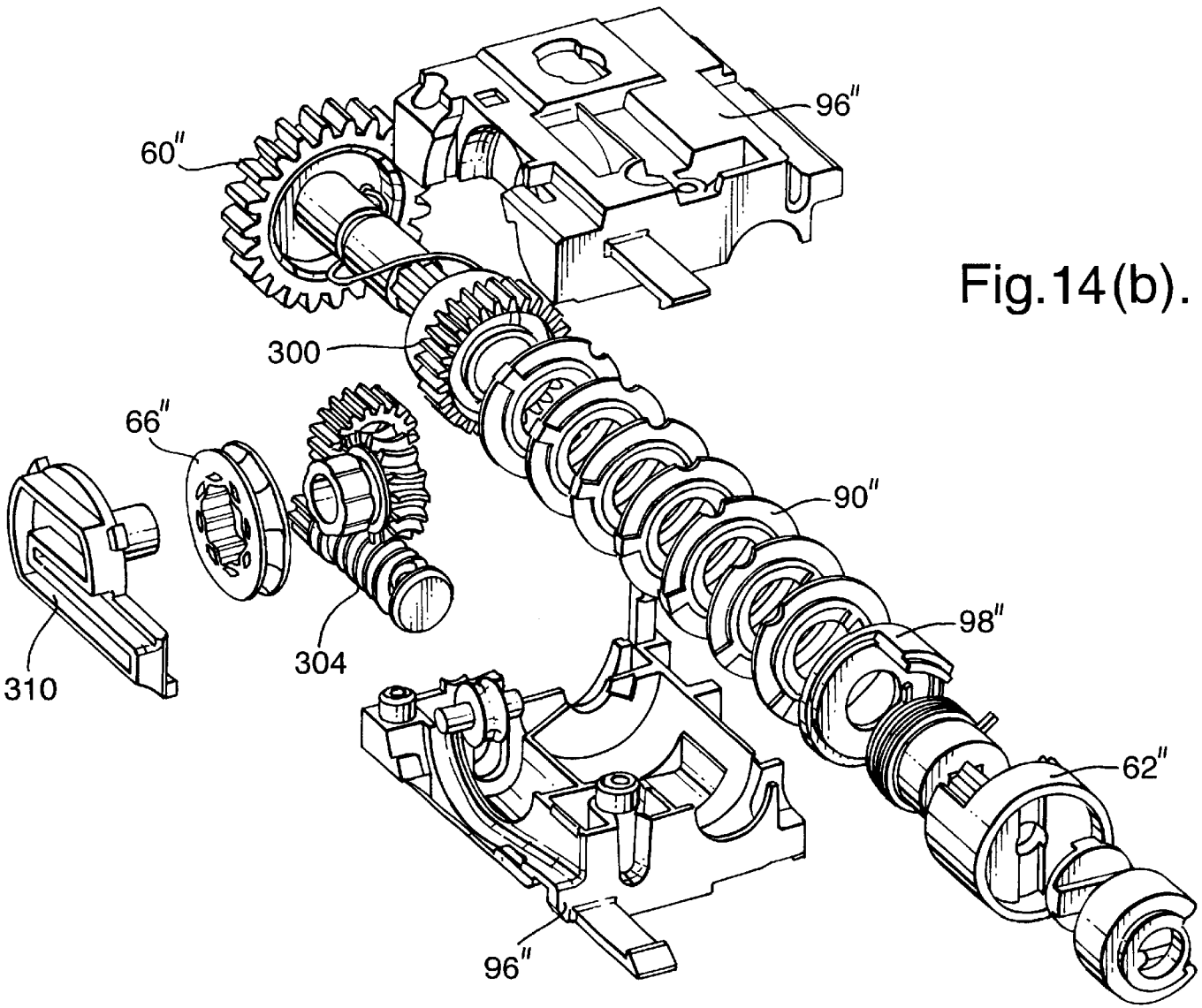
Figure 15:
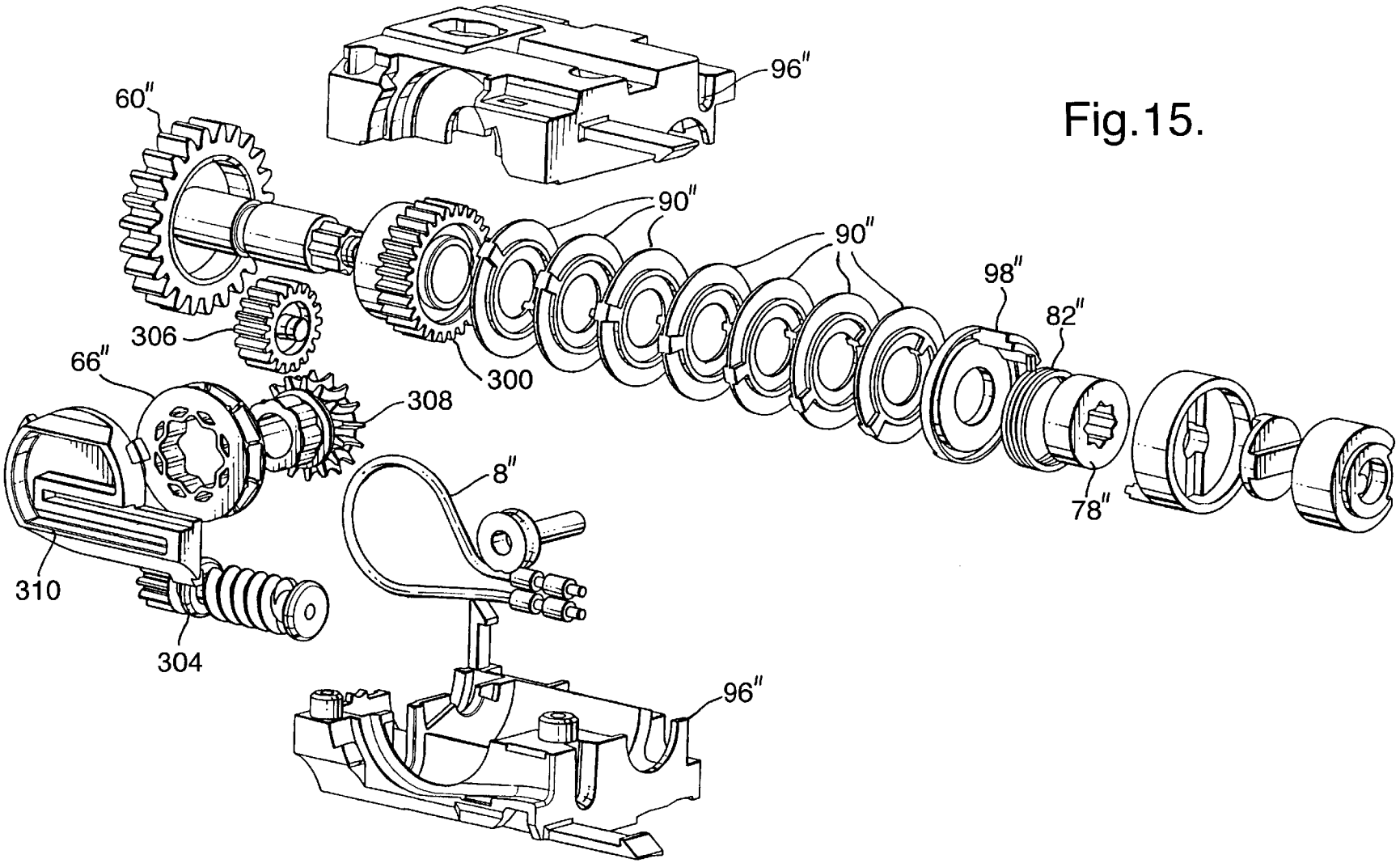
Figure 17:
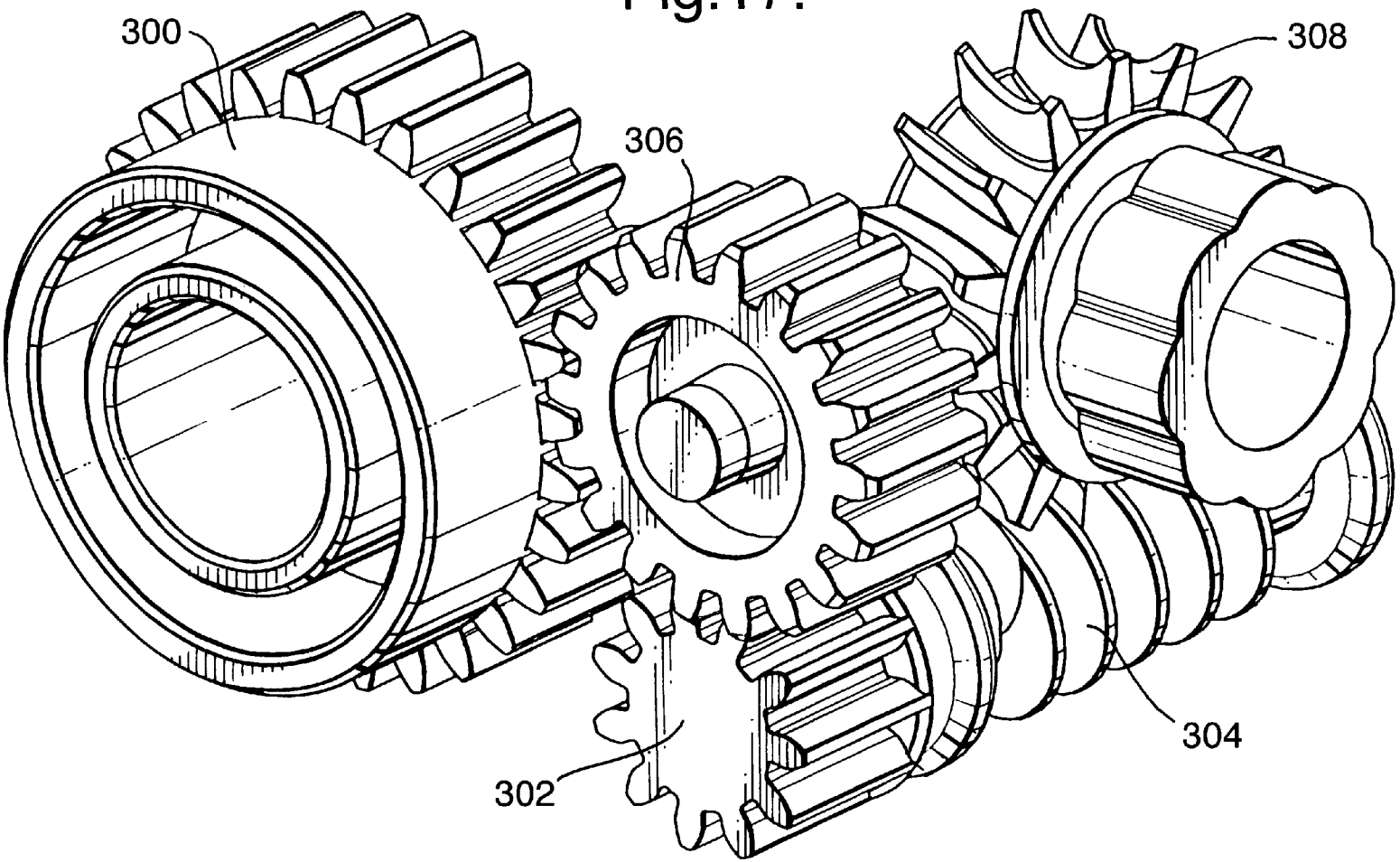
FIG. 17 illustrates the worm gear mechanism of FIGS. 14(*a*), 14(*b*) and 15.
Figure 18:
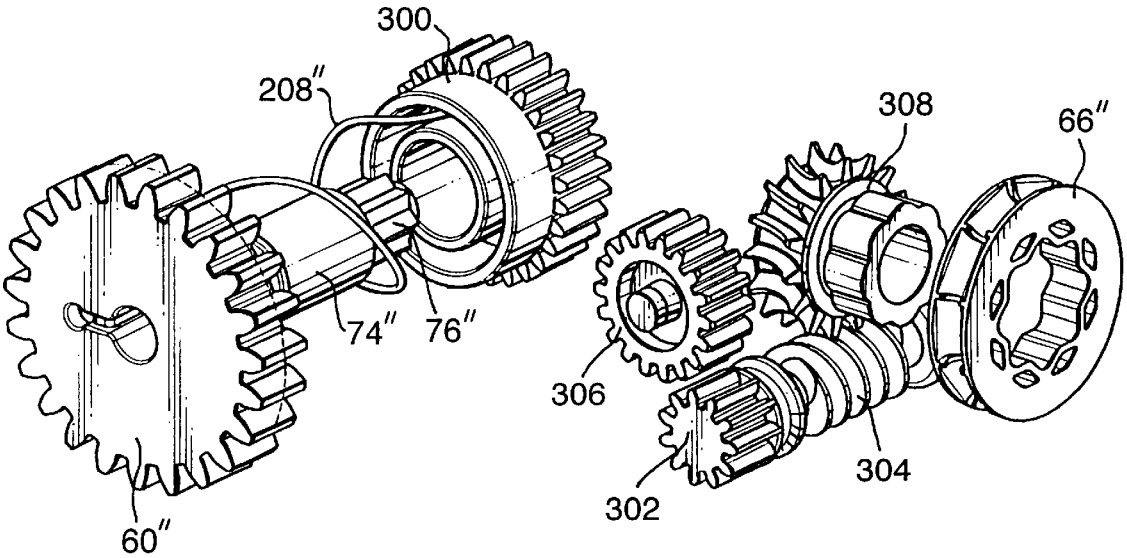
FIG. 18 illustrates the retract mechanism of FIGS. 14(*a*), 14(*b*) and 15.

In particular, the planet and crown gear mechanism is replaced by a worm gear mechanism and the second lost motion mechanism of the retract drive is arranged coaxially with the first lost motion mechanism of the tilt drive. The assembled mechanism is illustrated in FIG. 16.

As illustrated, in this embodiment, the tilt gear 60 or 60' of the previous embodiments acts as the sole drive gear 60". A retraction drive take-off gear 300 is provided coaxially with the drive gear 60" and rotatably on the shaft 74" of the drive gear 60". The lost motion mechanism for the retract drive is then provided by means of a flexible elongate member 208" similar to that of the previous embodiment which extends between the drive gear 60" and the retraction drive take-off gear 300. Hence, in this embodiment, the shaft 74" fulfills the function of the spacer 200 of the previous embodiment.

Rotation of the retraction drive take-off gear 300 is transferred to the pinion end 302 of a worm gear 304 by means of an intermediate gear 306. Thus, rotation of the retraction drive take-off gear 300 results in rotation of the worm gear 304.

As will be apparent from the figures, rotation of the worm gear 304 causes rotation of the mating worm wheel 308 and, hence, also the chain wheel 66".

By virtue of this worm gear arrangement, forces, for instance resulting from the weight of the blind are not transmitted back through the mechanism. In other words, the blind will remain where positioned despite forces acting on it.

Similarly to the previous embodiments, mating parts of the worm wheel 308 and chain wheel 66" provide an overload clutch. In this way, if the blind or retract chain 8" is forcably moved, for instance beyond one of its end positions, the chain wheel 66" is able to slip relative to the worm wheel 308 and prevent the mechanism from being damaged.

Since, compared to the previous embodiments, the chain wheel is provided vertically on the side of the mechanism, the housing 96" is provided with an opening which is filled by a chain wheel cover 310. Otherwise, this embodiment is generally similar to the previous embodiments with a plurality of lost motion wheels 90" driving a last wheel 98" and the tilt drive 62". It will be appreciated that the shaft 74" has, at its end, a non-circular cross-section end 76" which mates with the clutch drive component 78". As illustrated, this cross-section includes 8 protrusions.

For embodiments using the elongate flexible member 208, it is noted that particularly suitable cord materials would include high tensile strength yarns such as KEVLAR or NOMEX, both by DuPont, TWARON by Akzo-Nobel, DYNEEMA by DSM or SPECTRA by Allied Fibres. Such materials have tensile strengths in the range of 28 to 35 grams per denier. In particular, Ultra-High Molecular Weight Polyethylene (UHMW-PE), such as DYNEEMA or SPECTRA, has a tensile strength exceeding that of steel and has flexibility and fatigue resistance superior to Aramid fibres, such as KEVLAR, TWARON or NOMEX products. The first mentioned highly sophisticated polyethylene material is particularly suitable for high load applications and is also often referred to as High Modulus Polyethylene (HMPE) or High Molecular Density Polyethylene (HMDPE).

Referring again to the overall construction, since the drive mechanism includes a single drive train 60, 64, 72, 60', 64', 72', 60" for operating both the tilt drive and retract drive, a drive source may be meshed with the gear train at any position.

Figure 19:
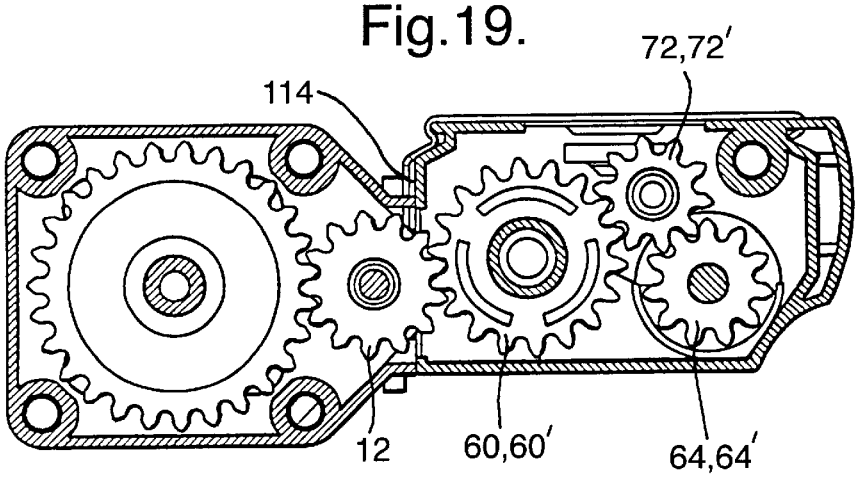
FIG. 19 illustrates a cross-section through the arrangement of FIG. 1 (*b*)
Figure 20:
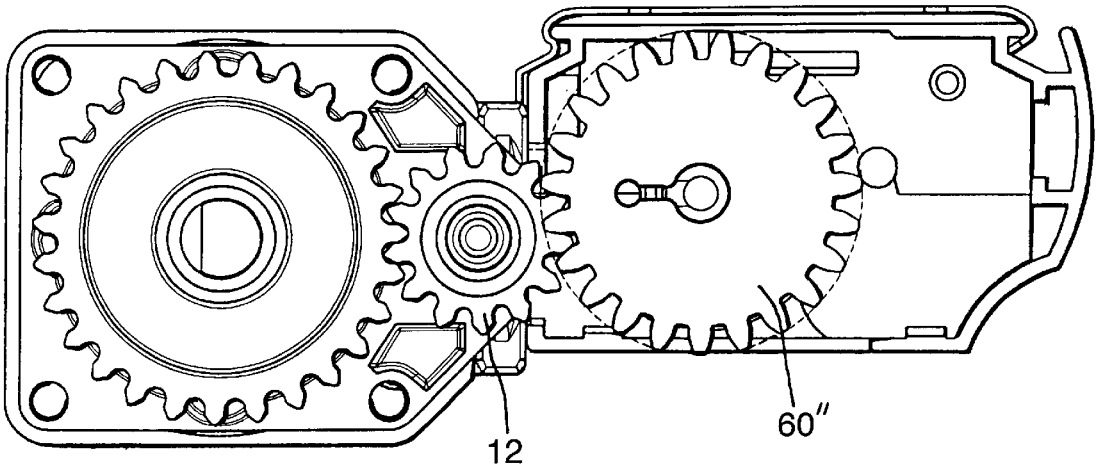
FIG. 20 illustrates an equivalent cross-section to FIG. 19 for the mechanism of FIG. 16.
Figure 21:
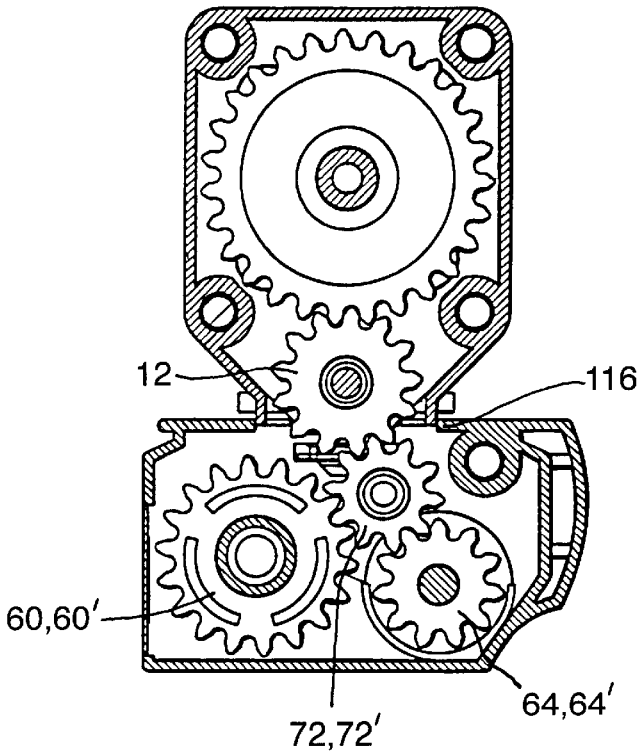
FIG. 21 illustrates a cross-section through the arrangement of FIG. 4(*b*)
Figure 22:
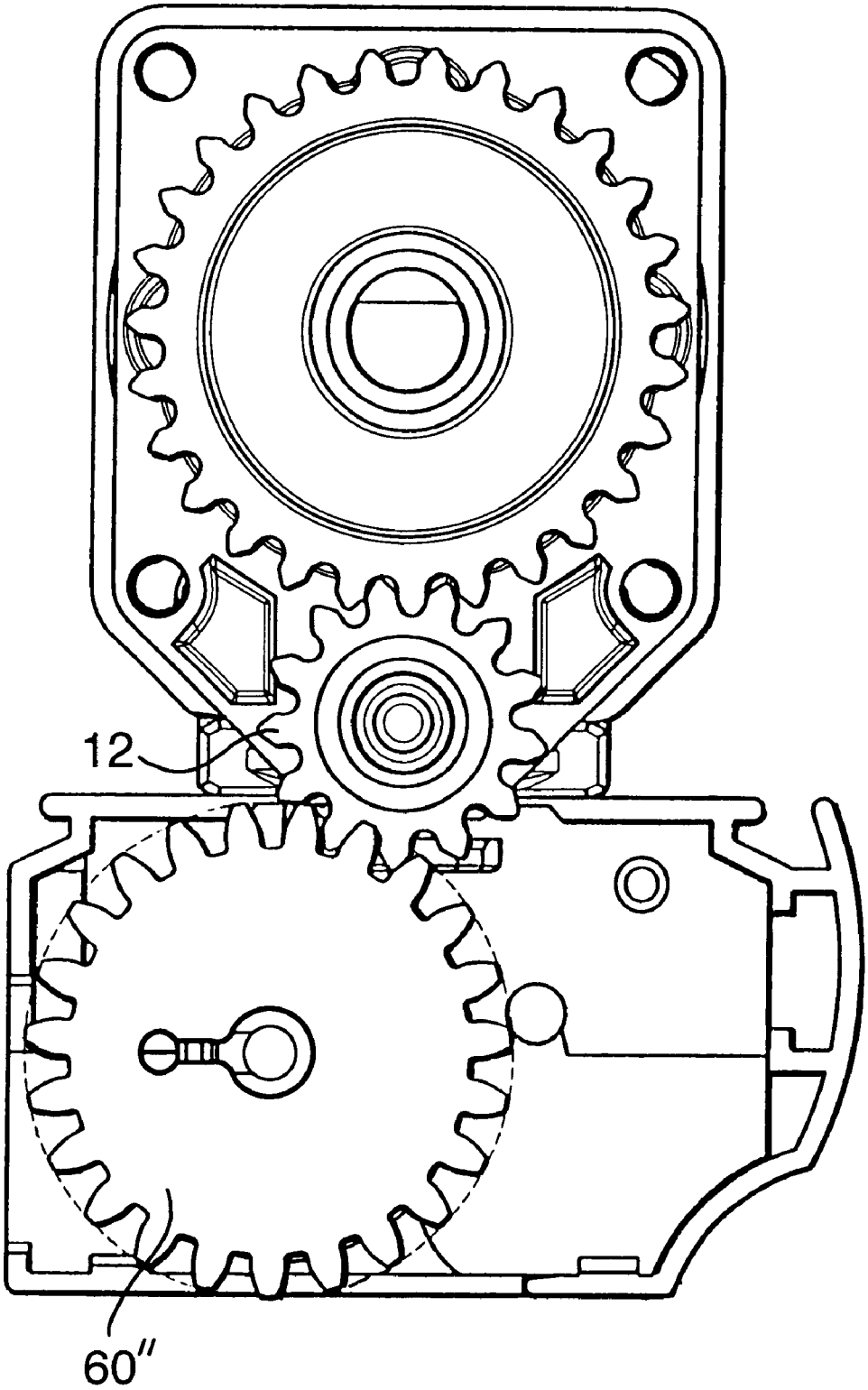
FIG. 22 illustrates an equivalent cross-section to FIG. 21 for the mechanism of FIG. 16.

FIGS. 19 and 20 correspond to the arrangement of FIGS. 1 and 2. In particular, the end cap 58 in which the drive mechanism is provided includes an opening 114 through which the drive gear 12 may mesh with the tilt gear 60. However, as described with reference to FIGS. 4, 5 and 6, it may be preferred to mount the motor unit 4 on top of the head rail 2. In this case, as illustrated in FIGS. 21 and 22, the end cap 58 includes an opening 116 on its upper surface such that the drive gear 12 can mesh with the intermediate gear 72. As illustrated in FIG. 7, the mechanism housing 96 preferably includes the non-circular opening 118 for receiving the non-circular head 18 of the latch 16. In this way, the relative positioning of the drive gear 12 and intermediate gear 72 can be secured.

For convenience the end cap 58 may be provided with both the opening 114 and 116. Additional components may be provided for filling or closing these openings when not in use.

It will be appreciated that the drive mechanism described with reference to FIGS. 7 and 8 could be used in conjunction with a manual cord operation. Indeed, a manual cord unit including a gear to mesh with the drive train 60, 64, 72 could be provided to attach to the head rail as a separate unit in place of the motor unit 4.

It will also be appreciated that the drive mechanism could be used to operate horizontal slats. Indeed, the head rail 2 could be mounted vertically in order to control horizontal slats.

We claim:

1. A head rail and motor unit assembly for a vertical venetian blind having an array of retractable and tiltable slats, the assembly including:

an elongate head rail having a mechanism at one end for tilting or retracting the slats of the vertical blind along the elongate bead rail; the mechanism having a rotatable control gear, the rotation of which controls the tilting or retracting; wherein the control gear is located at a position along the elongate head rail for operative coupling with a motor unit having a toothed drive gear; wherein the head rail includes a housing forming a generally enclosed structure, the housing including an aperture, through which the control gear meshes with the teeth of said toothed drive gear; wherein the housing has a first elongate surface, from which the slats are adapted to extend and at least one other elongate surface in which the aperture is formed; and wherein the motor unit is releasably attached to said at least one other elongate surface of the head rail.

2. The assembly according to claim 1 wherein the motor unit is a generally elongate structure having an elongate attachment surface for mounting alongside the at least one other elongate surface.

3. The assembly according to claim 1 wherein the mechanism is a drive mechanism including: a rotatable tilt drive for tilting the slats or a rotatable retract drive for retracting and deploying the slats; and a transmission for rotating the tilt drive or retract drive by rotating means; the transmission also including the control gear.

4. A head rail and motor unit assembly for a vertical venetian blind an array of retractable and tiltable slats, the assembly including:

an elongate head rail having a mechanism at one end for tilting or retracting the slats of the vertical blind along the elongate head rail; the mechanism having a rotatable control gear, the rotation of which controls the tilting or retracting; wherein the control gear is located at a position along the elongate head rail; wherein the head rail includes a housing forming a generally enclosed structure, the housing including an aperture, wherein the housing has an elongate surface, from which the slats are adapted to extend and at least one other elongate surface, in which said aperture is formed; and a motor unit for detachable attachment to the at least one other elongate surface of the head rail; the motor unit having a toothed drive gear for meshing with the control gear through said aperture; and the mechanism also including a lost motion mechanism comprising: first and second components relatively rotatable about a common axis; a spacer disposed between the first and second components; and a flexible elongate member having ends attached respectively to the first and second components; wherein relative rotation of the first and second components causes the flexible elongate member to wrap around the spacer such that the first and second components can rotate relative to one another by an amount determined by the length of the flexible elongate member; and wherein the lost motion mechanism is driven by the control gear to tilt or retract the slats.

5. The assembly according to claim 4 wherein the control gear is rotatable about an axis parallel to the longitudinal extent of the head rail.

6. The assembly according to claim 4 or 5 the mechanism includes: a rotatable tilt drive for tilting the slats or a rotatable retract drive for retracting and deploying the slats; and a transmission for rotating the tilt drive or retract drive by way of a single rotatable source.

7. The assembly according to claim 6 wherein the transmission includes a clutch for rotating the tilt drive.

8. The assembly according to claim 6 the retract drive is rotated by the transmission such that the retract drive is only rotated after a predetermined number of rotations of the transmission in the same direction; and wherein the lost motion mechanism is incorporated operatively between the retract drive and the transmission.

9. A vertical blind assembly including in combination an elongate head rail having opposite longitudinal ends, elongate top and rear side surfaces defined between the opposite longitudinal ends, an array of vertically disposed movable stats suspended from the head rail and a motor unit detachably mounted along one of the top and rear side surfaces of the head rail, wherein the head rail further includes a drive mechanism at one of its opposite longitudinal ends having a housing and at least one gear on said housing for controlling movement of said slats and wherein the motor unit includes a support structure and a drive gear on said support structure for releasably meshing with the at least one gear of the drive mechanism.

10. The vertical blind according to claim 9, wherein the housing includes an aperture through which the gears mesh.

11. The vertical blind according to claim 9, wherein the motor unit has an elongated attachment surface for mounting alongside one of the elongate top and rear surfaces of the head rail.

12. The vertical blind according to claim 9, wherein the motor unit includes a rotatable latch insertable through ah opening in the head rail.

13. The vertical blind according to claim 9, wherein the movement controlled by the at least one gear of the drive mechanism is a tilt and retract movement and wherein the drive mechanism includes a tilt drive and a retract drive.

14. The vertical blind according to claim 13, wherein the drive mechanism includes a lost motion mechanism operatively incorporated between the tilt drive and the retract drive.

15. A head rail and motor unit assembly for a vertical venetian blind having an array of retractable and tiltable slats, the assembly including:

an elongate head rail having a mechanism at one end for tilting or retracting the slats of the vertical blind along the elongate head rail; the mechanism having a rotatable control gear, the rotation of which controls the tilting or retracting; wherein the control gear is located at a position along the elongate head rail for operative coupling with a motor unit having a toothed drive gear; wherein the head rail includes a housing forming a generally enclosed structure, the housing including an aperture, through which the control gear meshes with the teeth of said toothed drive gear; wherein the housing has a first elongate surface, from which the slats are adapted to extend and at least one other elongate surface in which the aperture is formed; and wherein the motor unit is releasably attached to said at least one other elongate surface of the head rail, wherein the motor unit is a generally elongate structure having an elongate attachment surface for mounting along side the at least one other elongate surface and wherein, proximate the aperture, the at least one other elongate surface has a non-circular opening proximate the drive gear, and the motor unit includes a rotatable latch extending from the attachment surface and insertable through the non-circular opening for rotation so as to secure the motor unit to the head rail.

16. The assembly according to claim 15 further comprising a clip for holding the head rail at a position therealong and including a rotatable clip latch for selectively securing the clip to the motor unit at a position along its length.

17. The assembly according to claim 16 wherein the motor unit includes a lipped channel along at least part of the length of the attachment surface and the clip latch includes a key portion which can be rotated so as to be secured in the lipped channel.

18. The assembly according to claim 17 wherein the housing of the head rail includes a groove along at least part of the length of a surface opposite the at least one other parallel elongate surface and the clip includes a tongue for insertion into the groove.

19. A head rail and motor unit assembly for a vertical venetian blind having an array retractable and tiltable slats, the assembly including:

an elongate head rail having a mechanism at one end for tilting or retracting the slats of the vertical blind along the elongate head rail; the mechanism having a rotatable control gear, the rotation of which controls the tilting or retracting; wherein the control gear is located at a position along the elongate head rail for operative coupling with a motor unit having a toothed drive gear; wherein the head rail includes a housing forming a generally enclosed structure, the housing including an aperture, through which the control gear meshes with the teeth of said toothed drive gear; wherein the housing has a first elongate surface, from which the slats are adapted to extend and at least one other elongate surface in which the aperture is formed; and wherein the motor unit is releasably attached to said at least one other elongate surface of the head rail, wherein the mechanism is a drive mechanism including; a rotatable tilt drive for tilting the slats or a rotatable retract drive for retracting and deploying the slats; and a transmission for rotating the tilt drive or retract drive by rotation means; the transmission also including the control gear, and wherein the drive mechanism further includes the rotatable tilt drive and the transmission includes a clutch for rotating the tilt drive; the clutch incorporating a first lost motion mechanism whereby, after a predetermined number of rotations in the same direction, transmission by the clutch to the tilt drive is disengaged.

* * * * *

UNITED STATES PATENT AND TRADEMARK OFFICE

CERTIFICATE OF CORRECTION

PATENT NO. : 6,637,492 B2
DATED : October 28, 2003
INVENTOR(S) : Konrad Welfonder It is certified that error appears in the above-identified patent and that said Letters Patent is hereby corrected as shown below:

Column 15,
Line 8, after “5” insert -- wherein --;
Line 15, after “6” insert -- wherein --; and
Line 39, delete “ah” and insert -- an --.

Signed and Sealed this

Sixth Day of January, 2004

JAMES E. ROGAN
*Director of the United States Patent and Trademark Office*